US007249471B2

(12) United States Patent
Kawabuchi et al.

(10) Patent No.: US 7,249,471 B2
(45) Date of Patent: Jul. 31, 2007

(54) CUT DESIGN OF DIAMONDS PROVIDING PLENTY OF VISUAL-PERCEPTIBLE REFLECTION FOR ORNAMENTAL USE AND OBSERVATION METHOD THEREOF

(75) Inventors: Yoshinori Kawabuchi, Yokohama (JP); Tamotsu Matsumura, Avase (JP)

(73) Assignee: Hohoemi Brains, Inc. (JP)

( * ) Notice: Subject to any disclaimer, the term of this patent is extended or adjusted under 35 U.S.C. 154(b) by 69 days.

(21) Appl. No.: 11/087,917

(22) Filed: Mar. 23, 2005

(65) Prior Publication Data

US 2005/0166635 A1 Aug. 4, 2005

Related U.S. Application Data

(63) Continuation-in-part of application No. 10/350,388, filed on Jan. 23, 2003.

(30) Foreign Application Priority Data

Feb. 19, 2002 (JP) ..... 2002-041319
Aug. 30, 2002 (JP) ..... 2002-253011

(51) Int. Cl.
*A44C 17/00* (2006.01)

(52) U.S. Cl. ..... 63/33; 63/32

(58) Field of Classification Search ..... 63/32
See application file for complete search history.

(56) References Cited

U.S. PATENT DOCUMENTS 6,397,832 B1 * 6/2002 Shuto ..... 125/30.01
6,474,102 B1 * 11/2002 Buerger ..... 63/32
6,694,778 B2 * 2/2004 Kawabuchi et al. ..... 63/32
6,990,833 B2 * 1/2006 Smith ..... 63/32

* cited by examiner

*Primary Examiner*—Jack W. Lavinder
(74) *Attorney, Agent, or Firm*—McGlew and Tuttle P.C

(57) ABSTRACT

A cut design of an ornamental diamond and an observation method of the diamond which an observer can perceive a more beauty, are disclosed. The cut design is a round brilliant cut comprising a girdle, a crown above the girdle and a pavilion below the girdle. A girdle height (h) is 0.026 to 0.3 times a girdle radius, a pavilion angle (p) of a pavilion main facet ranges from 37.5 degrees to 41 degrees, and a crown angle (c) of a crown main facet is within a range of satisfying: $c>-2.8667\times p+134.233$ and $p<1/4\times\{(\sin^{-1}(1/n)+\sin^{-1}(1/n\cdot\sin c))\times 180/\pi+180\cdot 2c\}$, wherein n: refraction index of a diamond, π: circular constant, p: pavilion angle in degrees, and c: crown angle in degrees. The cut design of the ornamental diamond provides an observer with plenty of visual-perceptible reflection when the observer watches the diamond above a table facet with a sight line of an angle less than 20 degrees with a vertical line at the center of the table facet.

15 Claims, 21 Drawing Sheets

CUT DESIGN OF DIAMONDS PROVIDING PLENTY OF VISUAL-PERCEPTIBLE REFLECTION FOR ORNAMENTAL USE AND OBSERVATION METHOD THEREOF

CROSS-REFERENCES TO RELATED APPLICATIONS, IF ANY

This is a continuation-in-part of application Ser. No. 10/350,388, filed Jan. 23, 2003.

BACKGROUND OF THE INVENTION

1. Field of the Invention

The present invention relates to a cut design of ornamental diamonds and, more particularly, to a novel cut design of a diamond felt to be more beautiful by a person observing the diamond.

2. Description of the Related Art

In order to provide brilliant diamonds for use in ornaments by cutting, diamonds for ornamental use in the round brilliant cut having 58 facets and jewelry using such diamonds have been obtained.

Four criteria used in evaluating diamonds, commonly known as 4C's, are as follows:

1. Carat (unit of weight);
2. Color;
3. Cut (proportion, symmetry and polish); and
4. Clarity (quality and quantity of inclusions).

Regarding the weight expressed in carats, a diamond has traditionally been evaluated in size, which is measured in weight. The color depends on the raw gemstone; colorless and transparent stones are scarce and highly valued. The Gemological Institute of America (GIA) assigns D, E and F grades to colorless and transparent diamonds, and yellowish, if only slightly, ones are graded K or even lower. Cut design gives brilliancy and scintillation to a gem. The relative clarity is caused by inherent impurities and/or flaws of the raw gemstones.

Since the color and clarity are intrinsic to the gemstone, the only factor permitting artifice is the cut design, which determines brilliancy and scintillation. Therefore, studies have been continued to find cut designs that can enhance these attributes.

Mathematician Tolkowsky proposed what is known as the GIA system of cut design to increase the brilliancy of diamonds. The ideal cut according to the GIA system has a pavilion angle of 40.75 degrees, a crown angle of 34.50 degrees and a table diameter corresponding to 53% of the girdle diameter. Although a cut should be evaluated according to its contribution to beauty, more importance has been put on the yield from raw gemstone in determining a cut design of ornamental diamonds.

From the studies of the inventors about a cut design of ornamental diamonds for increasing brilliancy of the diamonds, the inventors proposed a cut design which permits simultaneous observation of lights coming into the diamond through crown facets and coming out from the crown facets, lights coming into the diamond through a table facet and out from the crown facets and lights coming into the diamond through the crown facets and out from the table facet, when a round brilliant cut diamond is observed from above the table facet of the diamond. To realize this feature, in the cut design, the pavilion angle (denoted as p hereafter) ranges from 45 degrees to 37.5 degrees and the crown angle (denoted as c hereafter) in degrees is within a range of satisfying the following equation:

$$-3.5\times p+163.6\leqq c\leqq -3.8333\times p+174.232.$$

The cut design was filed for patent as U.S. patent application Ser. No. 09/879,750 (filed Jun. 12, 2001). The center values of the pavilion angle (p) and the crown angle (c) are 38.5 degrees and 27.92 degrees, respectively.

The brilliancy of diamonds is a result of observer's perception on light which is reflected in a diamond after entering the diamond from the outside. The degree of brilliancy of a diamond is determined by the amount of light reflected from the diamond. The amount of light is ordinarily evaluated as a physical quantity of reflected light.

A result of human perception on brilliancy, however, is not determined by a physical quantity of reflected light alone. In order for a diamond to make an observer feel beautiful, the diamond must reflect a large amount of perceptible light, in the psycophysical meaning.

When an ornamental diamond is observed, light coming out through a table facet or crown facets of the diamond is perceived. If the amount of light coming out through a table facet or crown facets of a diamond is large, the diamond is evaluated as brilliant.

On the other hand, for a reason relating to working, a diamond which is cut in a round brilliant cut manner has, on the periphery of the boundary between the crown and the pavilion, a cylindrical surface or surfaces of a polygonal prism called a girdle. Ordinarily, the height (denoted as h hereafter) of the girdle is minimized. No study has been made about the relationship between the girdle height and the amount of reflected light.

SUMMARY OF THE INVENTION

An object of the present invention is to provide an ornamental diamond which can be felt highly brilliant when observed from above a table facet or crown facets, and which has a cut design exhibiting a large number of reflection ray patterns.

Another object of the present invention is to provide a cut design of an ornamental diamond having increased visual-perceptible reflection rays.

Still another object of the present invention is to provide an observation method suitable for a diamond which is brilliant cut in the above-described manner.

The present invention has been achieved as a result of a study on increasing visual-perceptible reflection rays on the basis of the cut design filed for patent by the inventors of the present invention in the above-mentioned patent application.

That is, an ornamental diamond in accordance with the present invention has such a cut design that the diamond exhibits its highest beauty when observed from a position right above the diamond, i.e., in a direction toward the table facet. To evaluate reflection rays reflected from a diamond in a study to achieve such a design, the concept of "visual-perceptible reflected rays" has been introduced as rays perceptible by a person observing a diamond, and a cut design has been evaluated by using the concept. Further, when a diamond is evaluated by observing in the direction toward the table facet, reflection rays (referred to as "effective visual-perceptible reflection rays") have been evaluated by using reflection rays corresponding to incident rays other than incident rays blocked by a person observing the diamond. The present invention provides a cut design and an observation method suitable for such practical observation. This evaluation is utterly different from the evaluation method conventionally used, in which a diamond was treated as a simple reflecting object and rays from the diamond were evaluated as opto-physical reflection rays.

A round brilliant cut design of an ornamental diamond, providing plenty of visual-perceptible reflection rays, according to the invention, comprises:

a substantially round or polygonal girdle having an upper horizontal section and a lower horizontal section parallel to the upper horizontal section;

a crown above the upper horizontal section of the girdle having a table facet and at least one crown main facet; and a pavilion below the lower horizontal section of the girdle having at least one pavilion main facet, wherein a girdle height (h) between the upper and the lower horizontal sections of the girdle is 0.026 to 0.3 times a girdle radius, a pavilion angle (p) between the pavilion main facet and the lower horizontal section of the girdle ranges from 37.5 degrees to 41 degrees and a crown angle (c) between the crown main facet and the upper horizontal section of the girdle is within a range of satisfying the following equations:

$$c>-2.8667\times p+134.233 \text{ and}$$

$$p<1/4\times\{(\sin^{-1}(1/n)+\sin^{-1}(1/n\cdot\sin c))\times 180/\pi+180-2c\},$$

wherein n: refraction index of a diamond,

π: circular constant, p: pavilion angle in degrees, and c: crown angle in degrees.

A girdle height (h) of the ornamental diamond according to the invention is preferably 0.030 to 0.15 times a girdle radius, which is a half of a girdle diameter. A table diameter of the diamond according to the invention is desirably 0.45 to 0.60 times a girdle diameter.

An observation method of an ornamental diamond, according to the invention, comprises the steps of:

providing an ornamental diamond of a round brilliant cut which comprises a substantially round or polygonal girdle having an upper horizontal section and a lower horizontal section parallel to the upper horizontal section, a crown on the upper horizontal section of the girdle having a table facet and at least one crown main facet, and a pavilion below the lower horizontal section of the girdle having at least one pavilion main facet, wherein a girdle height (h) between the upper and the lower horizontal sections of the girdle is 0.026 to 0.3 times a girdle radius, a pavilion angle (p) between the pavilion main facet and the lower horizontal section of the girdle ranges from 37.5 degrees to 41 degrees, and a crown angle (c) between the crown main facet and the upper horizontal section of the girdle is within a range of satisfying the following equations:

$$c>-2.8667\times p+134.233 \text{ and}$$

$$p<1/4\times\{(\sin^{-1}(1/n)+\sin^{-1}(1/n\cdot\sin c))\times 180/\pi+180-2c\},$$

wherein n: refraction index of a diamond,

π: circular constant, p: pavilion angle in degrees, and c: crown angle in degrees and observing, above the table facet of the diamond, lights coming into the diamond through the table facet and crown facets including the crown main facets, star facets and crown girdle facets, and coming out from the table facet and the crown facets with a sight line having an angle less than 20 degrees with a vertical line at the center of the table facet.

In the observation method of the invention, it is preferable to observe, from above the table facet, lights coming into the diamond through the table facet and the crown facets at an angle ranging from 10 degrees to 50 degrees with the vertical line at the center of the table facet and coming out from the table facet and the crown facets.

In the observation method, the lights more preferably come into the diamond at an angle ranging from 20 degrees to 45 degrees with the vertical line at the center of the table facet of the diamond.

In the observation method of the invention, it is preferable that the diamond has a girdle height (h) of 0.030 to 0.15 times the girdle radius. And it is desirable that the diamond has a table diameter of 0.45 to 0.60 times a girdle diameter.

The cut design of an ornamental diamond of the invention is applied to a round brilliant cut which usually comprises:

a substantially round or polygonal girdle having an upper horizontal section surrounded by an upper periphery and a lower horizontal section, parallel to the upper horizontal section, surrounded by a lower periphery;

a crown of a nearly polygonal truncated pyramid formed upward above the upper horizontal section of the girdle having a regular octagonal table facet at the top of the polygonal truncated pyramid, eight crown main facets, eight star facets and sixteen upper girdle facets; and a pavilion of a nearly polygonal pyramid formed downward below the lower horizontal section of the girdle having eight pavilion main facets and sixteen lower girdle facets.

In the round brilliant cut, a center axis is defined as a straight line standing from a center apex of the pavilion polygonal pyramid through a center of the table facet; a first plane is one running from the center axis through each of eight vertexes of the table facet; and a second plane is one running from the center axis and dividing an angle between the two neighboring first planes into two equal angles. Using the definitions, each facet on the crown of the round brilliant cut can be expressed as follows: Each of the crown main facets is a rectangular plane surface or a kite-shaped surface having two opposite vertexes, one being one of vertexes of the table facet and the other being a cross point of the upper periphery of the girdle with a first plane passing the vertex of the table facet. The rectangular plane surface has other two opposite vertexes each positioned on a neighboring second plane and coinciding with a vertex of a neighboring crown main facet. Each of the star facets is a triangle having a base coinciding with a side of the table facet and a vertex coinciding with a coinciding vertex of two neighboring crown main facets each having a side passing each of the both ends of the base. Each of the upper girdle facets is a triangle having a side coinciding with one of sides of a crown main facet and crossing the upper periphery of the girdle at an end of the side and a vertex at which a second plane passing the other end of the side crosses the upper periphery of the girdle.

Each facet on the pavilion of an ordinary round brilliant cut can be expressed as follows: Each of the pavilion main facets is a rectangular plane surface or a kite shaped surface having two opposite vertexes, one being a cross point of a first plane with the lower periphery of the girdle and the other being at the center apex of the pavilion polygonal pyramid. The rectangular plane surface has other two opposite vertexes each positioned on a neighboring second plane. The pavilion main facets each has a side coinciding with a side of a neighboring pavilion main facet and two vertexes coinciding with two vertexes of the neighboring pavilion main facet. Each of the lower girdle facets is a triangle having a side coinciding with a side of one of the pavilion main facets and crossing the lower periphery of the girdle at an end of the side and a vertex at which the second plane passing the other end of the side crosses the lower periphery of the girdle.

The invention can be applied to a modified round brilliant cut in which one of the crown and the pavilion of the ordinary round brilliant cut is turned by 22.5 degrees around the center axis. When a crown in the modified round brilliant cut is fixed as in the ordinary round brilliant cut, each facet on a pavilion of the modified round brilliant cut can be expressed as follows: Each of the pavilion main facets is a rectangular plane surface or a kite shaped surface having two opposite vertexes, one being a cross point of a second plane with the lower periphery of the girdle and the other being at the center apex of the pavilion polygonal pyramid. The rectangular plane surface has other two opposite vertexes each positioned on a neighboring first plane. The pavilion main facets each having a side coinciding with a side of a neighboring pavilion main facet and two vertexes coinciding with two vertexes of the neighboring pavilion main facet. Each of the lower girdle facets is a triangle having a side coinciding with a side of one of the pavilion main facets and crossing the lower periphery of the girdle at an end of the side and a vertex at which the first plane passing the other end of the side crosses the lower periphery of the girdle.

DETAILED DESCRIPTION OF THE PREFERRED EMBODIMENTS

Structure of Round Brilliant Cut Diamond

Figure 1A:
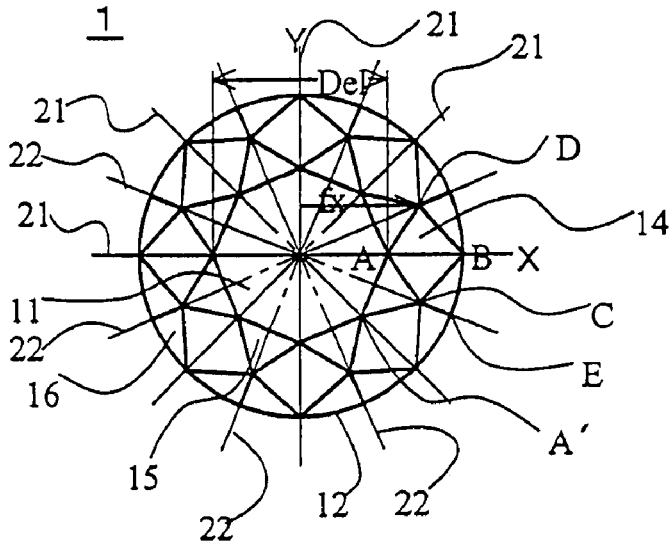
FIGS. 1A, 1B and 1C are a top view, a side view and a bottom view, respectively, of an ornamental diamond with a cut design in accordance with the present invention.
Figure 1B:
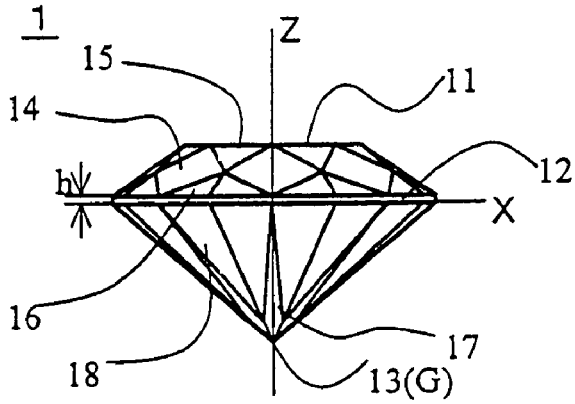
Figure 1C:
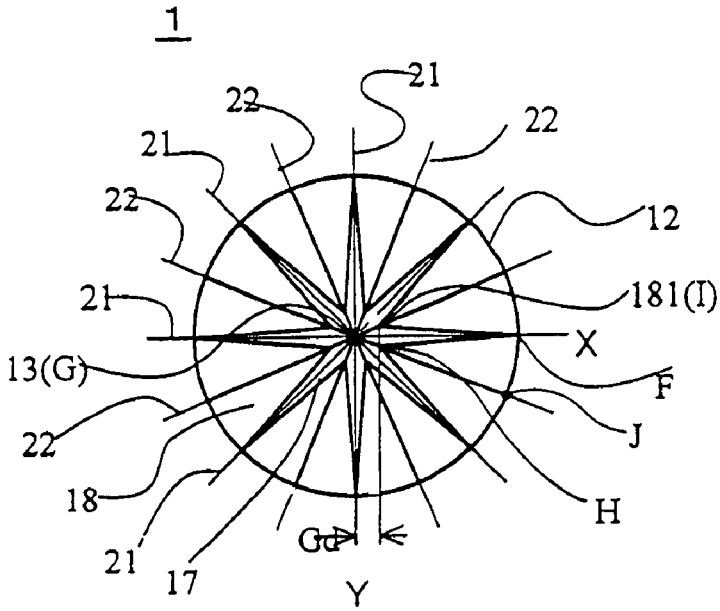
Figure 2:
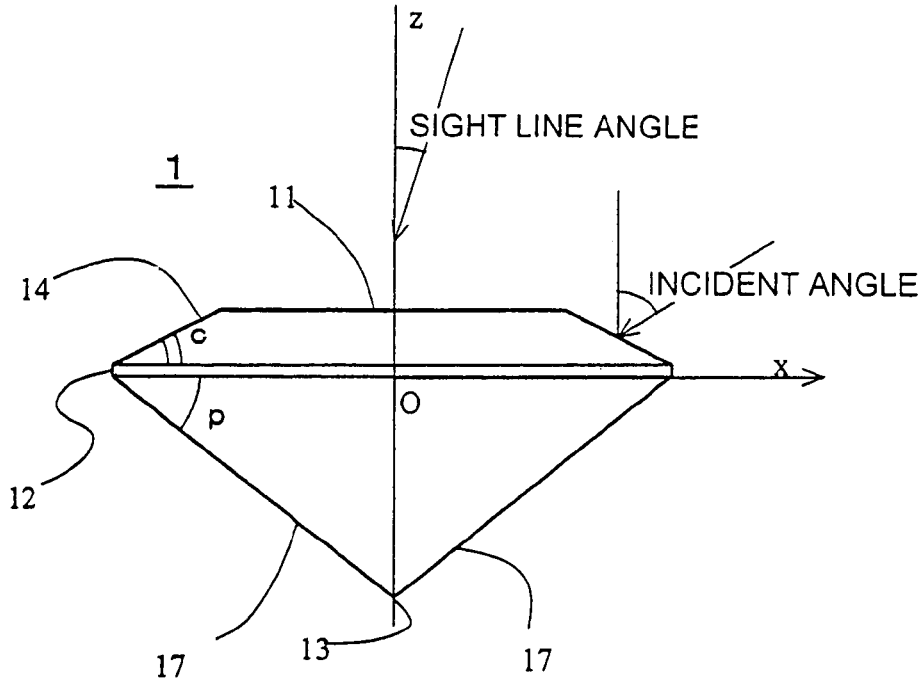
FIG. 2 is a cross-sectional view of the ornamental diamond in FIG. 1 along the zx-plane.

An external appearance of a cut design of a diamond 1 according to the present invention is shown in FIG. 1, and its section is shown in FIG. 2. FIG. 1A is a top view; FIG. 1B a side view; and FIG. 1C a bottom view. Herein the top is a table facet 11 of a regular octagon, a girdle 12 is a round or polygon above which is a crown having substantially a polygonal truncated pyramid with the table facet constituting a top facet of the pyramid. Below the girdle 12 is a pavilion forming substantially a polygonal pyramid downwardly from the girdle. At the center apex of the pavilion is a portion known as a culet 13. On the circumference of the crown, there are usually eight main facets or bezel facets 14; eight star facets 15 are formed between the circumference of the table and the main facets; and sixteen upper girdle facets 16 are formed between the girdle 12 and the main facets 14. On the circumference of the pavilion, usually eight main facets 17 are formed, and sixteen lower girdle facets 18 are formed between the girdle and the main facets. The outer surfaces or facets of the girdle 12 are perpendicular to the table facet.

A straight line passing through a center of the table facet and the center apex of the pavilion polygonal pyramid will be referred to as a center axis (also referred to as z-axis in the description below); each of planes containing the center axis and the vertexes of the regular octagon of the table facet, as a first plane; and a plane containing the center axis and bisecting the angle formed between adjacent two of the first planes, a second plane.

For a reason relating to explanation, coordinate axes (right hand system) are provided in the diamond, as shown in FIGS. 1 and 2. The z-axis is perpendicular to the table facet and passes through the table facet center with its plus direction corresponding to the upward direction from the table facet, and the origin O is set at a center of the girdle. In FIG. 2, the y-axis is not shown since it extends backward from the origin O.

The first planes are the zx-plane and planes obtained by rotating the zx-plane in 45° steps about the z-axis. The first planes are indicated by 21 in FIG. 1. The second planes are planes obtained by turning the first planes by 22.5 degrees about the z-axis. The second planes are indicated by 22 in FIG. 1.

Referring to FIG. 1A, each crown main facet 14 is a rectangular plane surface or a kite-shaped surface having two opposite vertexes, one coinciding with one of the vertexes of the regular octagonal table facet 11 (e.g., vertex A shown in FIG. 1A) and the other being a cross point B at which the first plane 21 containing the vertex A (e.g., the zx-plane) intersects the upper periphery of the girdle. The rectangular plane surface has other two opposite vertexes each positioned on the neighboring second plane 22 and has one vertex C or D common with each of the neighboring crown main facets 14. Each star facet 15 is a triangle AA'C defined by one side AA' of the regular octagonal table facet 11 and by one vertex coinciding with the common vertex C of the two neighboring crown main facets 14 respectively having vertexes coinciding with the opposite end points A, A' of the side. Each upper girdle facet 16 is a surface defined by one side (e.g., CB), among the sides of one crown main facet 14, intersecting the upper periphery of the girdle 12 at its one end, and by a point E at which the second plane 22 containing the other end C of the side intersects the upper periphery of the girdle 12.

Referring to FIG. 1C, each pavilion main facet 17 is a rectangular plane surface or a kite-shaped surface having two opposite vertexes, one coinciding with a point F at which one of the first planes 21 (e.g., the zx-plane) intersects the lower periphery of the girdle 12, and the other coinciding with a center apex G of the pavilion polygonal pyramid. The rectangular plane surface has other two opposite vertexes H, I each positioned on the neighboring second plane 22 and has one side GH or GI and one vertex H or I common with each of the neighboring pavilion main facet 17. Each lower girdle facet 18 is a surface defined by one side (e.g., FH), among the sides of one pavilion main facet 17, intersecting the lower periphery of the girdle 12 at one end F of the side and by a point J at which the second plane 22 containing the other end H of the side intersects the lower periphery of the girdle 12. Here the description is made without mentioning a culet apex 13.

Each crown main facet 14 is interposed between an adjacent pair of the second planes 22, and each pavilion main facet 17 is also interposed between an adjacent pair of the second planes 22. A common side CE of each adjacent pair of the upper girdle facets 16 and a common side HJ of the corresponding adjacent pair of the lower girdle facets 18 are on one of the second planes 22. Between the corresponding adjacent pair of the first planes 21 are interposed one star facet 15, two upper girdle facets 16 having the common side CE, and two lower girdle facets 18 having the common side HJ. These two upper girdle facets 16 and these two lower girdle facets 18 are positioned almost opposite to each other with the girdle 12 interposed therebetween.

Each of the first planes 21 bisects the corresponding crown main facet 14 and the corresponding pavilion main facet 17. Accordingly, each crown main facet 14 and the corresponding pavilion main facet 17 are almost opposite to each other with the girdle 12 interposed therebetween.

In the following description, the size of each portion of the diamond is expressed in units in terms of the ratio to the diameter or radius of the girdle. The girdle height (h) is the dimension of the girdle in the z-axis direction and is expressed as the ratio to the girdle radius.

In FIG. 2, which shows a sectional view, the same constituent parts are assigned respectively the same reference numerals as in FIG. 1. Here, the angle formed by the main facets or bezel facets 14 of the crown with a horizontal section (XY plane) of the girdle, i.e. the crown angle, is denoted by c, while the angle formed by the main facets 17 of the pavilion with the horizontal section (XY plane) of the girdle, i.e. the pavilion angle, is denoted by p. Hereafter in this specification, the main facets or bezel facets, the star facets and the upper girdle facets in the crown may be collectively referred to as the crown facets, and the main facets and the lower girdle facets in the pavilion, as the pavilion facets.

In FIG. 1, the girdle height (h), the table diameter (Del), the distance (fx) to a star facet end, and the distance (Gd) to the vertex of each lower girdle facet in the pavilion portion are indicated. As shown in FIG. 1A, the table diameter (Del) is twice the distance from the z-axis to the vertexes of the regular octagon of the table 11. The distance (fx) to the star facet end is used to express the distance of the points of intersection of the star facets, the bezel facets and the upper girdle facets provided in the crown from the yz-plane containing the diamond center axis (z-axis). The distance (fx) is a projection of the distance from the z-axis to the star facet end onto the zx-plane. The distance (Gd) to the vertex of each lower girdle facet provided in the pavilion represents the distance on the zx-plane from the z-axis to the culet-side vertex 181 of each pavilion lower girdle facet and equals a value obtained by multiplying the distance from the center axis (z-axis) by cos 22.5°.

To specify the size of the diamond, the crown height, the pavilion depth and the total depth other than the table diameter or size (the ratio to the girdle diameter) may be used. These factors are determined when the table diameter, the pavilion angle (p) and the crown angle (c) are given. Therefore they will not be referred to in this specification.

Study Procedures of Optical Paths

For this specification, optical paths were studied in the following procedure.

(1) The diamond was supposed to be symmetrical around the z-axis at every 45 degrees, and every 45 degree segment, to be symmetrical with respect to a plane (e.g. the zx-plane). The starting points of inward and outward optical paths were considered in a region of half of this segment, i.e. a 22.5 degree region. For instance, to look for the destination (emission point) and optical path of a light coming in a certain point at a certain angle, incident lights from latticed points in this area of 22.5 degrees were traced. The whole optical paths could be easily estimated from the symmetry.

(2) In tracing optical paths, each light ray was represented by a vector having starting point coordinates (Xi, Yi, Zi) and directional unit vector (1, m, n), and each facet of the diamond, by a vector having known point coordinates (a, b, c) on the plane and its normal unit vector (u, v, w) to the plane. A diamond cut in this way had, in a 45 degree region, a total of eight faces comprising the table facet, the crown main facet or bezel facet, two upper girdle facets, the star facet, the pavilion main facet and two lower girdle facets, and seven more sets of these facets when turned by 45 degrees at a time.

(3) Optical paths, angles of emission, points of emission, reflection and refraction (angles of intersection between light rays and planes) were determined by vector calculation.

Thus, points of reflection, refraction and emission were calculated as points of intersection between these lines and planes (solutions to simultaneous equations).

Equation for lines: $(x-Xi)/1=(y-Yi)/m=(z-Zi)/n$

Equation for planes: $u(x-a)+v(y-b)+w(z-c)=0$

The points of intersection were calculated as solutions of these simultaneous equations, and the points of intersection with each plane were sequently and consistently calculated so as to obtain a right solution satisfying the conditions.

Directional changes (vectors after directional change) of optical paths upon incidence and refraction were calculated with the refraction index and synthetic vectors which were constituted of the vectors of incident light and of planar direction. Calculation was done in the same way for reflection, though the form of synthetic vectors was different. Light rays after directional change were represented by lines having these points of intersection as starting points.

Angles formed by planes and light rays were calculated as scalar products of the normal vectors of facets and the directional vectors of light rays, and where such an angle was smaller than a critical angle, emission took place as refraction, while reflection occurred where it was greater. For each case of reflection, the point of intersection between the light ray and the plane after the directional change was figured out anew, and the same calculation was performed.

(4) These optical path calculations were applied as appropriate both to the line of gaze (tracing from the observing side to the source of light) and to the light ray (from the light source to the point of observation). Thus the tracing of the optical path from the emitting side to the light source and that of the optical path from the light source side to the emitting point were calculated based on the same principle.

(5) Incident white light was separated into the spectrum during multiple reflections in the diamond and red component emerges from facets when it came to the facets at an angle less than the critical angle, while blue remained in the diamond. For the destinations of the blue components the optical paths were figured by the above-described method.

Introduction of Visual-perceptible Reflection Rays

In the study described below, the amount of visual-perceptible (reflection) rays were measured as described below.

As a law concerning the amount of visual-perceptible rays, the Fechner's law and the Stevens' law are known (S. S. Stevens, "To Honor Fechner and Repeal His Law" *Science*, Vol. 133, 80-86). In the Fechner's law, the amount of visual-perceptible rays is a logarithm of an amount of physical rays. If the Stevens' law is applied to measurement of light from a light source assumed to be a point light source, the amount of visual-perceptible rays is the square root of the amount of physical rays. Many instances of conclusions from these laws are considered generally the same and error-free, although they are quantitatively different. In the study described below, a method was used in which the brilliancy of a diamond was evaluated by obtaining the amount of visual-perceptible rays on the basis of the Stevens' law and by using the obtained amount of rays as the amount of visual-perceptible reflection rays if the obtained rays are reflection rays.

In the study described below, a procedure was used in which amounts of visual-perceptible reflection rays were the square root of values of tenths of the amount of physical reflection rays with respect to patterns having areas larger than 30 meshes among patterns of reflection rays from a diamond, and the sum of the amounts of visual-perceptible reflection rays was obtained with respect to all the patterns.

The amount of physical reflection rays was obtained in such a manner that meshes are defined by dividing the radius of the diamond into 100 equal segments and the ray density was obtained with respect to each mesh. Since the radius of diamonds is several millimeters, a mesh area is several hundred square micrometers. The amount of light was calculated only with respect to patterns of 30 meshes or larger by considering the area perceptible by human eyes.

When a brilliant cut diamond is observed in a direction toward the table facet, it exhibits rotational symmetry at each of turning angles of 45 degrees and also exhibits bilateral symmetry at a turning angle of 22.5 degrees in each 45° range. Therefore, measurement of the amount of rays with respect to each of segments cut by the planes in the 22.5°-step constellation containing the center axis (z-axis) may suffice.

That is, the amount of visual-perceptible reflection rays was calculated by the following equation:

The amount of visual-perceptible reflection rays=$\Sigma\{$(the amount of physical reflection rays with respect to patterns of 30 meshes or more in each segment)$/10\}^{1/2}$, in which $\Sigma$ is the sum of patterns in one segment.

Comparison of Visual-perceptible Reflection Rays with Physical Reflection Rays

Figure 3:
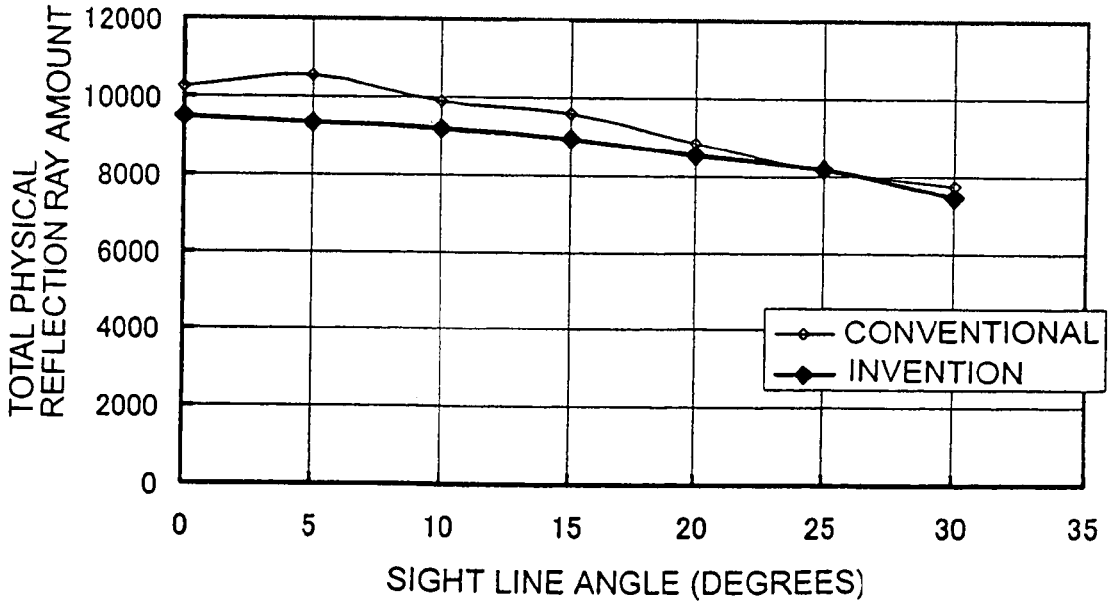
FIG. 3 is a graph showing the total amount of physical reflection rays from each of the diamonds of the present invention and a conventional diamond with respect to the sight line angle.
Figure 4:
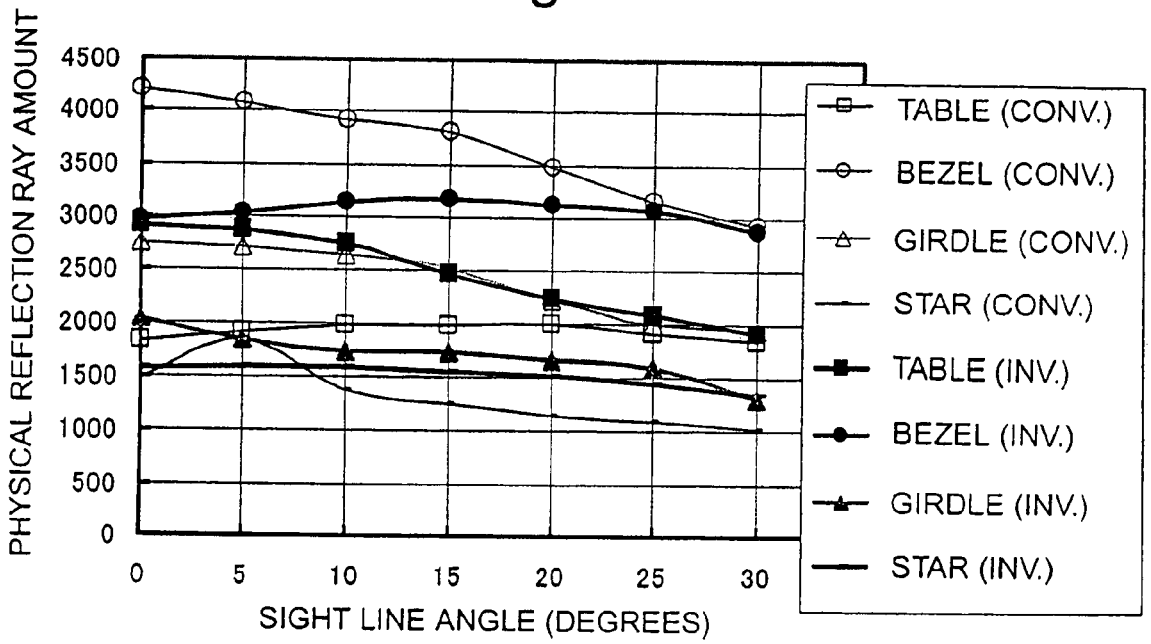
FIG. 4 is a graph showing the physical reflection ray amounts from the facets of each of the diamonds of the present invention and the conventional diamond with respect to the sight line angle.
Figure 5:
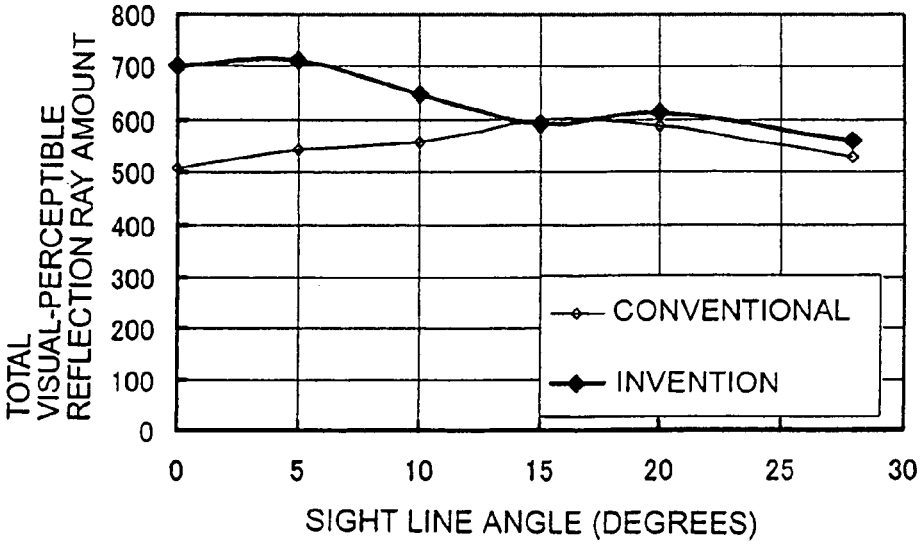
FIG. 5 is a graph showing the total visual-perceptible reflection ray amounts from each of the diamond of the present invention and the conventional diamond with respect to the sight line angle.
Figure 6:
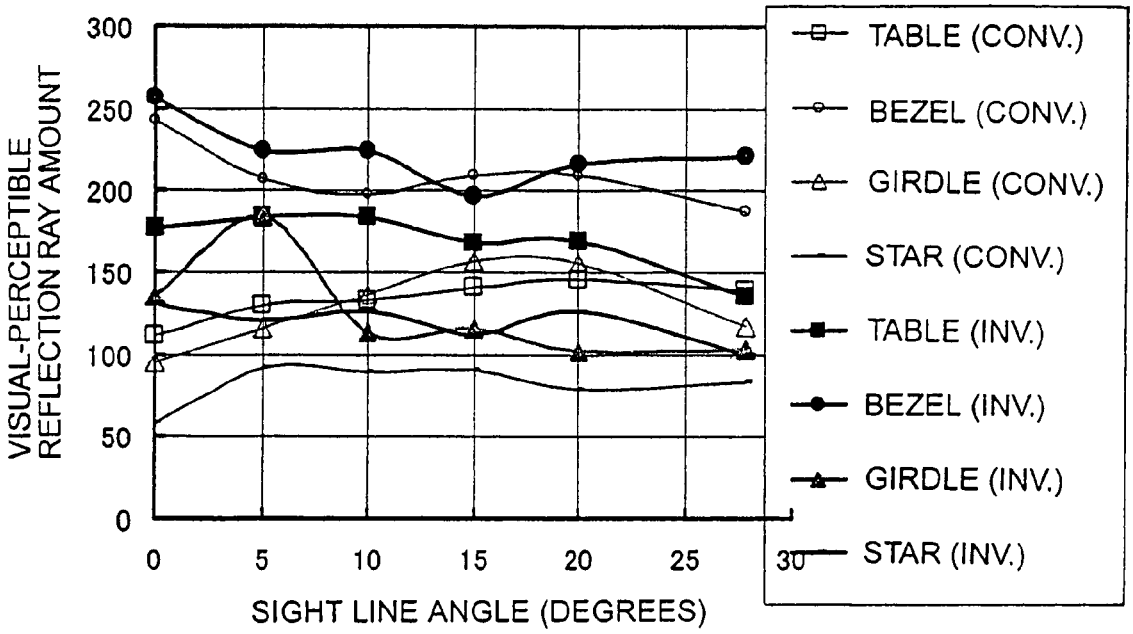
FIG. 6 is a graph showing the physical reflection ray amounts from the facets of each of the diamonds of the present invention and the conventional diamond with respect to the sight line angle.
Figure 7:
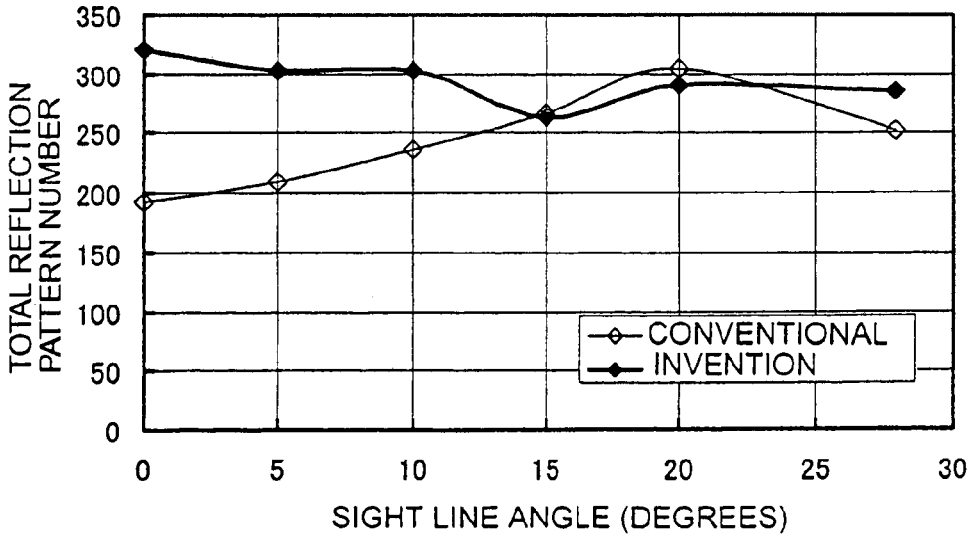
FIG. 7 is a graph showing the total reflection ray pattern number from each of the diamonds of the present invention and the conventional diamond with respect to the sight line angle.
Figure 8:
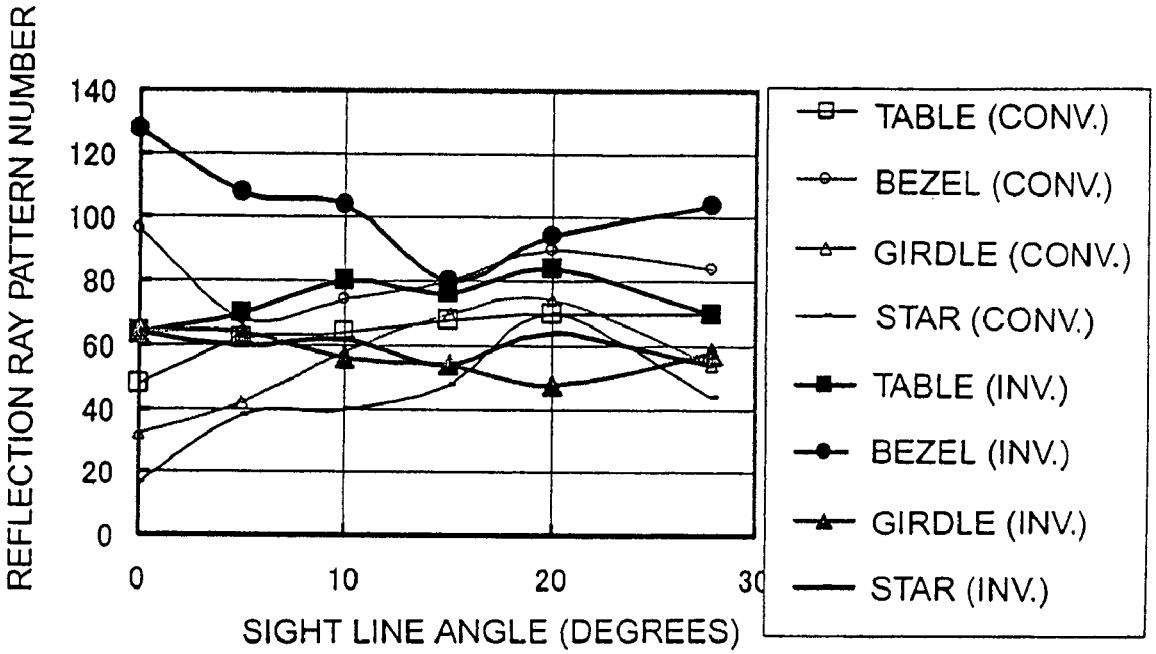
FIG. 8 is a graph showing the reflection ray pattern numbers from the facets of each of the diamonds of the present invention and the conventional diamond with respect to the sight line angle.
Figure 9:
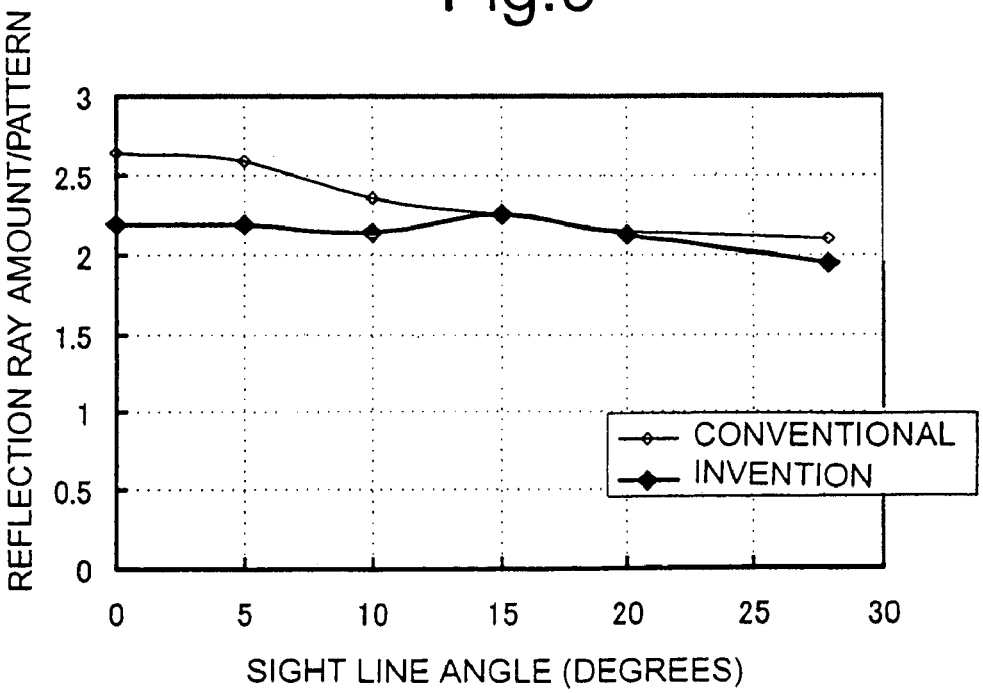
FIG. 9 is a graph showing the amount of reflection rays per pattern from each of the diamonds of the present invention and the conventional diamond with respect to the sight line angle.
Figure 10:
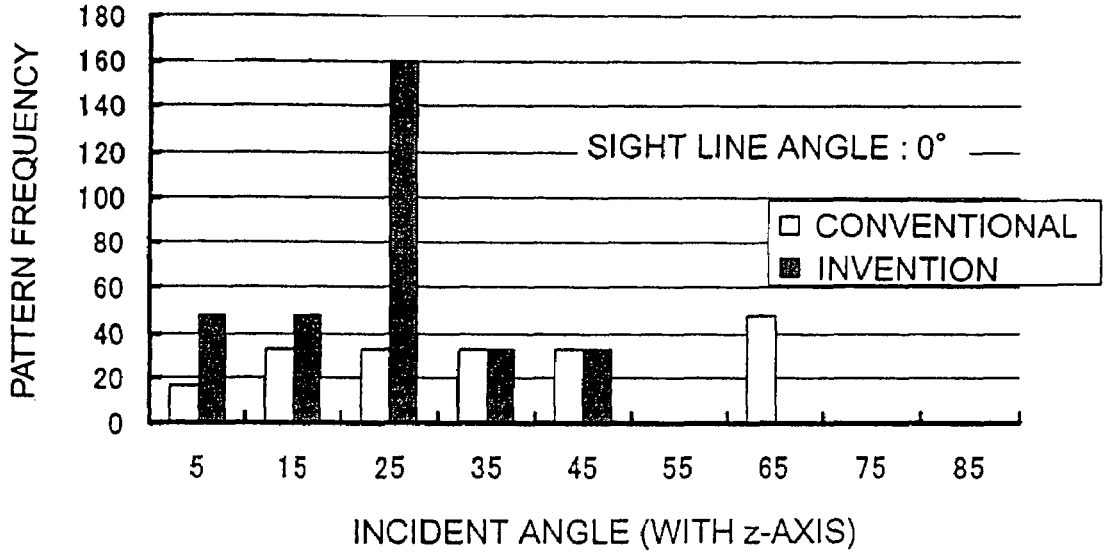
FIG. 10 is a histogram showing the pattern frequency at a sight line angle of 0 degree for each of the diamonds of the present invention and the conventional diamond with respect to the incident angle (with z-axis)
Figure 11:
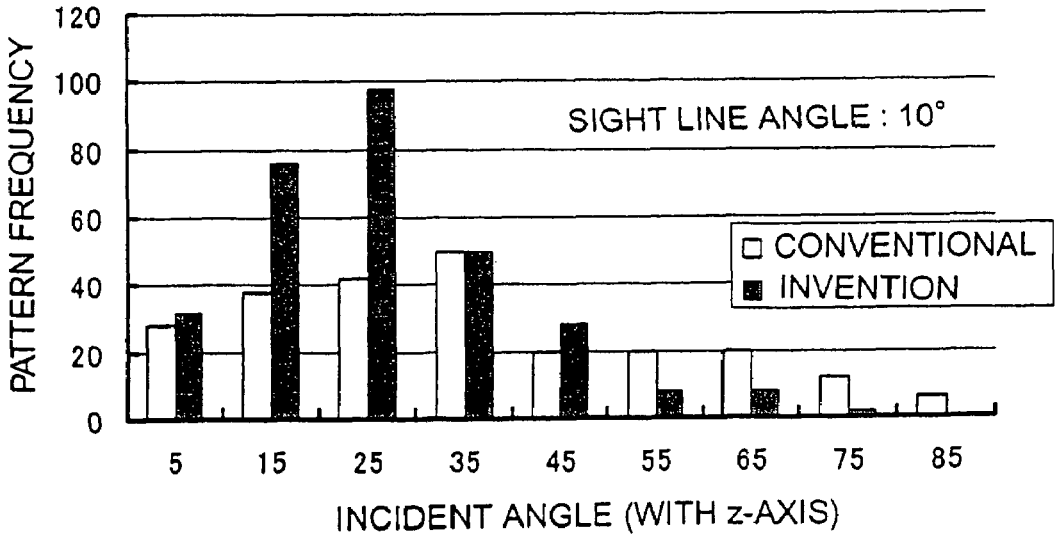
FIG. 11 is a histogram showing the pattern frequency at a sight line angle of 10 degrees for each of the diamonds of the present invention and the conventional diamond with respect to the incident angle (with z-axis)
Figure 12:
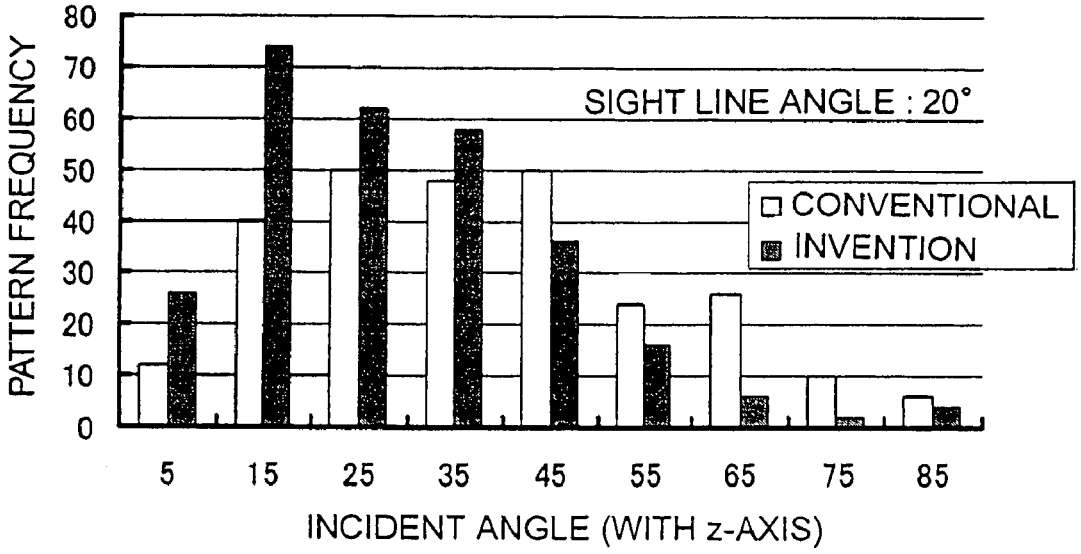
FIG. 12 is a histogram showing the pattern frequency at a sight line angle of 20 degrees for each of the diamonds of the present invention and the conventional diamond with respect to the incident angle (with z-axis)
Figure 13:
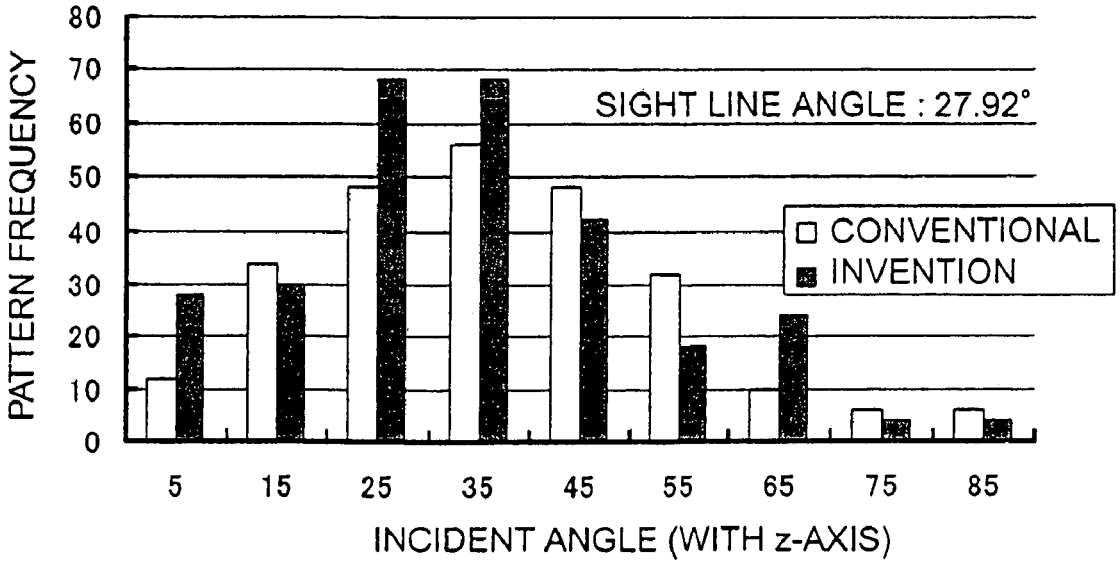
FIG. 13 is a histogram showing the pattern frequency at a sight line angle of 27.92 degrees for each of the diamonds of the present invention and the conventional diamond with respect to the incident angle (with z-axis)

Of the round brilliant cut diamond of the present invention and a conventional round brilliant cut diamond, the amounts of physical reflection rays, the amounts of visual-perceptible reflection rays, and the numbers of reflection ray patterns were examined by observing in a direction toward the table facet along the z-axis as shown in FIG. 2. This observation was performed by inclining the angle of the sight line with zero degree to 27.92 degrees. The line of sight was inclined in the zx plane as shown in FIG. 2. The amount of reflection rays was further examined by rotating the sight line in the xy plane about the z-axis. However, the results of this examination were omitted in this specification. The configurations of the diamond samples are as described below. In the diamond of the present invention, the pavilion angle (p) is 38.5 degrees; the crown angle (c), 27.92 degrees; the table diameter (Del), 0.55; the star facet end distance (fx), 0.75; the lower girdle facet vertex distance (Gd), 0.2; and the girdle height (h), 0.026. In the conventional diamond, the pavilion angle (p) is 40.75 degrees; the crown angle (c), 34.5 degrees; the table diameter (Del), 0.53; the star facet end distance (fx), 0.7; the lower girdle facet vertex distance (Gd), 0.314; and the girdle height (h), 0.02. FIG. 3 is a graph showing the total amounts of physical reflection rays from the diamond of the present invention and the conventional diamond when the sight line angle was changed. FIG. 4 is a graph showing the amounts of physical reflection rays from the facets of the diamond of the present invention and the conventional diamond when the sight line angle was changed. FIG. 5 is a graph showing the sums of the amounts of visual-perceptible reflection rays from the diamond of the present invention and the conventional diamond when the sight line angle was changed. FIG. 6 is a graph showing the amounts of visual-perceptible reflection rays from the facets of the diamond of the present invention and the conventional diamond when the sight line angle was changed. FIG. 7 is a graph showing the sums of the numbers of reflection ray patterns of the diamond of the present invention and the conventional one when the sight line angle was changed. FIG. 8 is a graph showing the numbers of reflection ray patterns of the diamond of the present invention and the conventional one when the sight line angle was changed. FIG. 9 is a graph showing the amounts of reflection rays per pattern of the diamond of the present invention and the conventional one when the sight line angle was changed.

As shown in the graph of FIG. 3, the sum of the amounts of physical reflection rays from the conventional round brilliant cut diamond when the diamond is observed along the z-axis direction from a position right above the table facet (when the sight line angle is zero) is slightly larger than that from the diamond of the present invention. When the sight line angle defined in FIG. 2 is increased to about 25 degrees, the amounts of physical reflection rays from the diamond of the present invention and the conventional one become approximately equal to each other as shown in FIG. 3. The graph of FIG. 4 shows the amount of physical reflection rays from each of the facets above the girdle of the diamond, i.e., the table facet and the crown facets (the bezel facets, the upper girdle facets, the star facets). The amount of physical reflection rays from the bezel facets of the conventional diamond is particularly large. The amount of physical reflection rays from the bezel facets of the diamond of the present invention is also large and, in particular, the amount of reflection rays from the table facet of the diamond of the present invention is larger than that from the table facet of the conventional one.

FIGS. 5 and 6 show the results of comparison between the amounts of reflection rays in terms of visual-perceptible reflection rays from the diamond of the present invention and the conventional diamond when the diamond of the present invention and the conventional diamond were observed in the same manner. FIG. 5 shows the sum of the amounts of visual-perceptible reflection rays from the facets. In the case of observation when the sight line angle was smaller than 15 degrees, the diamond of the present invention was brighter than the conventional one by about 30%. When the sight line angle was in the range from 15 to 25 degrees, the amounts of visual-perceptible reflection rays from the diamond of the present invention and the conventional one were approximately equal to each other. As is apparent from the comparison of FIG. 5 with FIG. 3, the diamond of the present invention is dimmer than the conventional one in the amount of physical reflection rays, but is much brighter than the conventional one in the amount of visual-perceptible reflection rays. The results of comparison show that the amount of rays perceptible by an observer from the diamond of the present invention is larger than that from the conventional one, and that the diamond of the present invention can be perceived by an observer to be more brilliant than the conventional one. When the sight line angle is increased exceeding 15 degrees, the amounts of visual-perceptible reflection rays from the diamond of the present invention and the conventional one become approximately equal to each other. Therefore it is preferable for the diamond of the present invention to be observed along a direction close to the z-axis on the table facet. As shown in FIG. 6, the amount of visual-perceptible reflection rays from the bezel facets is the largest, that from the table facet is the second largest, and that from the girdle facets is the third.

FIGS. 7 and 8 show the results of comparison between the numbers of reflection patterns of reflection rays from the diamond of the present invention and the conventional diamond. FIG. 7 shows the sum of numbers of reflection ray patterns, and FIG. 8 shows the numbers of reflection ray patterns on facets with respect to the sight line angle. It can be understood from FIG. 7 that the number of patterns of the diamond of the present invention is larger by 60 to 70% than that of the conventional one. It is apparent from FIG. 8 that the number of patterns of the bezel facets is increased.

FIG. 9 is a graph in which the amount of reflection rays obtained per reflection ray pattern with respect to the sight line angle is plotted. In the case of observation along a line close to the perpendicular to the table facet of the diamond at the center of the same (when the sight line angle is small), the amount of reflection rays per pattern from the diamond of the present invention is smaller than that from the conventional one. From the fact, it is apparent, when considering with FIG. 7, that the diamond of the present invention has increased finer patterns. However, when the sight line angle is 15 degrees or larger, the amount of reflection rays per pattern from the diamond of the present invention is substantially the same as that from the conventional diamond.

FIGS. 10, 11, 12 and 13 are histograms showing the frequencies of patterns obtained from incident rays at incident angles with the z-axis, ranging in steps of 10 degrees, with respect to observation of the diamonds at sight line angles of 0, 10, 20 and 27.92 degrees shown in FIG. 7, in which the sum of numbers of reflection ray patterns of the diamond of the invention and the conventional diamond are shown. In these histograms, angles in the 10-degree ranges are indicated on the abscissa, and the numeric values indicated on the abscissa are middle values in the ranges. For example, "5" denotes the range from 0 to 10 degrees. In the results of observation of the invention diamond at a sight line angle of 0 degree shown in FIG. 10, the largest part of the resulting patterns correspond to rays incident on the diamond at incident angles indicated by 25, i.e., in the angular range from 20 to 30 degrees, and no patterns exist which correspond to rays incident at angles equal to or larger than 50 degrees. On the other hand, in the case of the conventional diamond, patterns are widely distributed with respect to the range of incident angles from 0 to 70 degrees. In the results of observation at a sight line angle of 10 degrees shown in FIG. 11, the diamond of the present invention has patterns distributed with respect to incident angles from 0 to 80 degrees. However, most of the patterns are formed by incident rays at incident angles from 10 to 40 degrees. In the results of observation at a sight line angle of 20 degrees shown in FIG. 12, the diamond of the present invention has most of its patterns formed by incident rays at incident angles from 10 to 50 degrees. In the results of observation at a sight line angle of 27.92 degrees shown in FIG. 13, incident rays forming patterns for the invention are distributed further widely and the distribution becomes similar to that in the case of the conventional diamond.

From the above-described comparison between the diamond of the present invention and the conventional diamond, the following can be positively said.

(a) The conventional diamond prevails over the diamond of the present invention in some degree in the amount of physical reflection rays, but the diamond of the present invention is superior to the conventional one in the amount of visual-perceptible reflection rays. The amount of visual-perceptible reflection rays from the crown main facets (bezel facets) is particularly large.

(b) The diamond of the present invention has a larger number of reflection ray patterns than that of the conventional one. Also, the amount of reflection rays per pattern is smaller than that of the conventional diamond. This means that the diamond of the present invention has an increased number of finer patterns.

(c) When the diamond of the present invention is observed at a sight line angle of 20 degrees, reflection ray patterns formed by incident rays at incident angles of 10 to 50 degrees with the z-axis are mainly observed. In the case of observation at a sight line angle of 10 degrees, reflection ray patterns are mainly formed by incident rays at incident angles of 10 to 40 degrees. A diamond is evaluated through the amount of reflection rays formed by rays incident at angles of 20 to 45 degrees with the z-axis since incident rays at a small incident angle with the z-axis are blocked by the observer in front of the diamond and do not enter the diamond, as described below.

(d) The above-described features are noticeable when the sight line angle is 20 degrees or smaller, particularly 15 degrees or smaller. That is, the features can be recognized at the time of observation from a position right above the table facet.

Girdle Height Dependency in Visual-perceptible Reflection Rays

Figure 14:
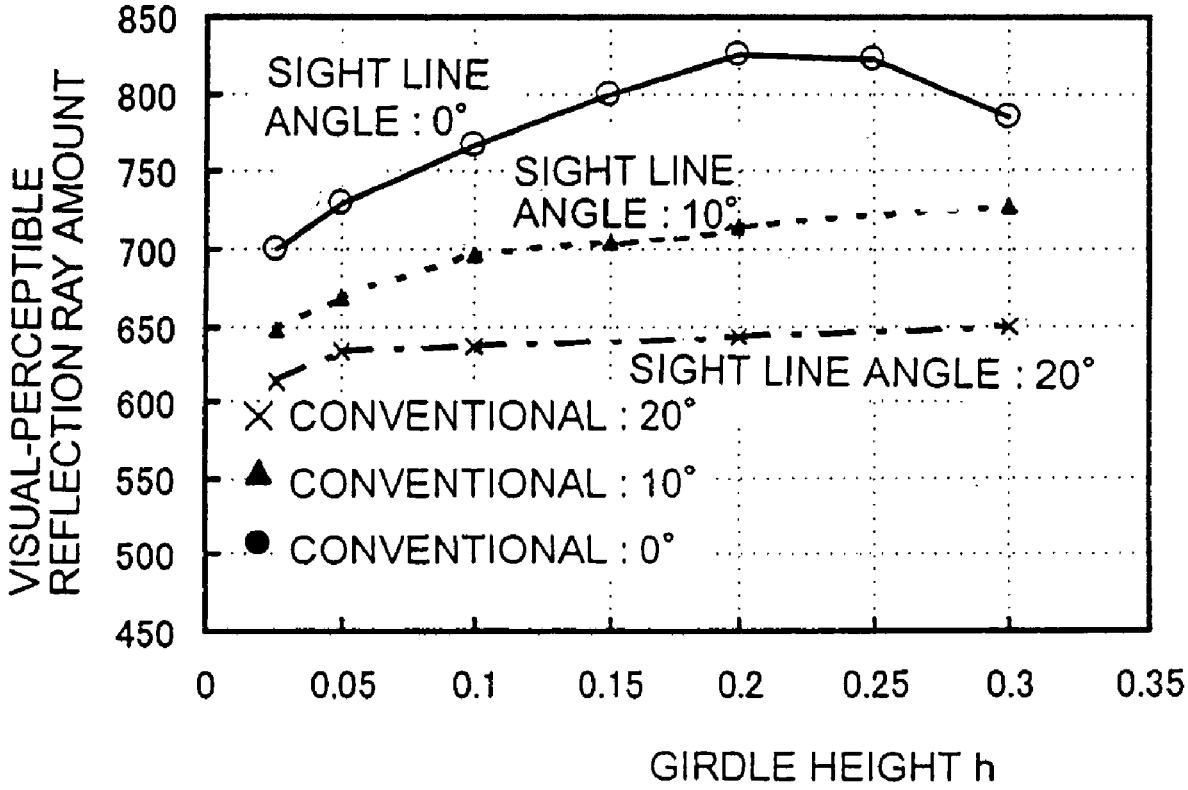
FIG. 14 is a graph showing the visual-perceptible reflection ray amount at each of sight line angles 0, 10 and 20 degrees with respect to the girdle height (h)

The relationship between the girdle height (h) and the amount of visual-perceptible reflection rays was examined. The amounts of visual-perceptible reflection rays from brilliant cut diamonds having a pavilion angle (p) of 38.5 degrees and a crown angle (c) of 27.92 degrees were measured by observation along the z-axis direction on the table facet with respect to different girdle height (h) values from 0.025 to 0.3. The graph of FIG. 14 shows the results of this measurement. In FIG. 14, the abscissa represents the girdle height (h) with reference to the girdle radius. The ordinate represents the amount of visual-perceptible reflection rays. In FIG. 14, the curve drawn as a solid line indicates results of observation along the z-axis, the curve drawn as a broken line indicates results of observation at an angle of 10 degrees from the z-axis (hereafter referred to as "sight line angle"), and the curve drawn as a dot-dash line indicates results of observation at an angle of 20 degrees from the z-axis (sight line angle of 20 degrees). Dots labeled with "conventional: 0°", "conventional: 10°", and "conventional: 20°" at the lower left corner of the graph respectively indicate the amounts of visual-perceptible reflection rays from a diamond with a conventional brilliant cut, having a pavilion angle (p) of 40. 75 degrees and a crown angle (c) of 34.5 degrees, and having the girdle height (h) set to 0.02 of the girdle radius when the diamond was observed along the z-axis, when the diamond was observed at an angle of 10 degrees with the z-axis, and when the diamond was observed at an angle of 20 degrees with the z-axis.

As is apparent from FIG. 14, the amounts of visual-perceptible reflection rays from the diamonds with the cut design in accordance with the present invention are much larger than that from the diamond with the conventional cut design. Also, in the diamond with the cut design of the present invention, the amounts of visual-perceptible reflection rays are increased if the girdle height (h) is increased. The largest amount of visual-perceptible reflection rays is exhibited when the sight line angle is 0 degree. The amount of visual-perceptible reflection rays is reduced as the inclination of the line of sight is increased. Even when the sight line angle is 20 degrees, the amounts of visual-perceptible reflection rays from the diamonds with the cut design of the present invention are larger than that from the diamond with the conventional design. When sight line angle is 0 degree, the amount of visual-perceptible reflection rays is maximized at h: 0.2 and is slightly reduced if the height is larger. However, the amount of visual-perceptible reflection rays when the sight line angle is 0 degree is larger even at h: 0.3 than that when the sight line angle is 10 degrees. From these results, it can be understood that it is effective to increase the girdle height (h) in increasing the amount of visual-perceptible reflection rays. The amount of visual-perceptible reflection rays is large when the girdle height (h) is not larger than 0.3.

FIG. 15 shows optical paths along which the rays come out through the facets of a diamond when reflection rays are observed along the z-axis direction of the diamond. FIG. 15A shows optical paths along which rays come out along the z-axis direction of a round brilliant cut diamond having a pavilion angle (p) of 38. 5 degrees and a crown angle (c) of 27.92 degrees. Rays coming out through the table facet are rays which have come in through the crown facets. Rays coming out through portions close to the periphery of the table facet are rays which have come in through portions of the crown facets close to the girdle. Also, rays which have come in through the girdle surfaces or facets come out through portions close to the periphery of the table facet.

Figure 16:
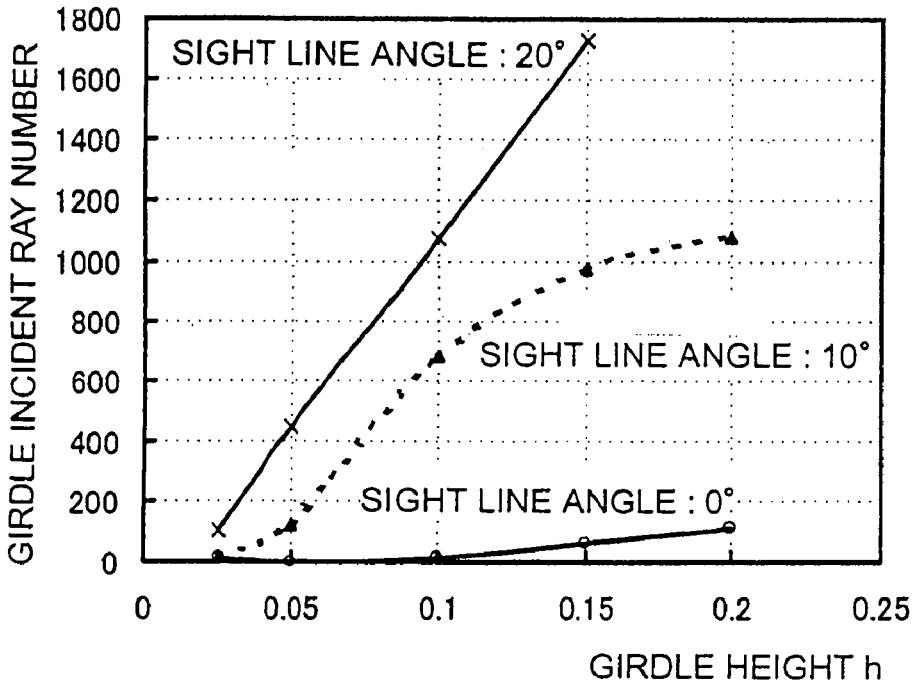
FIG. 16 is a graph showing the number of girdle incident rays with respect to the girdle height (h) when the diamonds of the present invention is observed at each of sight line angles 0, 10 and 20 degrees.

FIG. 16 is a graph in which the proportions of rays coming in through the girdle surfaces or facets in reflection rays coming out along the z-axis direction are plotted. If the girdle radius is divided into 100 equal segments, about 31000 meshes are formed in a girdle cross section (a cross section perpendicular to the z-axis). Assuming that one ray comes out per mesh, the ordinate in FIG. 16 shows, in units corresponding to this ray, the number of incident rays coming in through the girdle surfaces or facets. The abscissa in FIG. 16 represents the girdle height (h) in terms of the ratio to the girdle radius.

FIG. 16 shows the number of incident rays coming in through the girdle surfaces or facets when the girdle height (h) is changed from 0.026 to 0.2 with the sight line angle used as a parameter. Whatever the sight line angle is, the amount of rays coming in through the girdle surfaces or facets increases when the girdle height (h) is increased. When the sight line angle is 0 degree, the number of incident rays from the girdle is small. However, when the sight line angle is 10 degrees, 976 rays come in through the girdle surfaces or facets at the girdle height of 0.15, and this number of rays is about 3% of the total number of rays. When the sight line angle is 20 degrees, 1734 rays come in through the girdle surfaces or facets at the girdle height of 0.15, and this number of rays is about 5.5% of the total number of rays.

Most of rays coming in through the girdle surfaces or facets are observed in the vicinity of the periphery of the table facet, as mentioned above. In most cases, however, even a girdle portion of an ornamental diamond is embedded in a mounting. The girdle surfaces or facets of a diamond set in a mounting are covered with the mounting. Rays coming in through the girdle surfaces or facets are thereby reduced, so that portions of the table facet closer to the periphery become dimmer. If the girdle height of a diamond is increased, the proportion of rays coming in through the girdle surfaces or facets is increased. In such a case, if the diamond is set in a mounting so as to obstruct rays coming in through the girdle surfaces or facets, the dim portions existing in the vicinity of the periphery of the table facet become larger. Preferably, the proportion of rays coming in through the girdle surfaces or facets in all rays is set to about 5% or smaller. More preferably, the proportion is set to 3% or smaller. A diamond is observed not always from a position right above the table facet but also along a slightly inclined line. If a reduction of about 5% in brightness is tolerated in a case where a diamond having a girdle height (h) of 0.15 or lower is set in a mounting and the diamond becomes dimmer due to blockage of light by the mounting, the angle of inclination of the diamond at the time of observation, i.e., the sight line angle, may be set to a value smaller than about 20 degrees. If the tolerance is limited to 3%, the angle of inclination may be set to a value equal to or smaller than 10 degrees.

Figure 17:
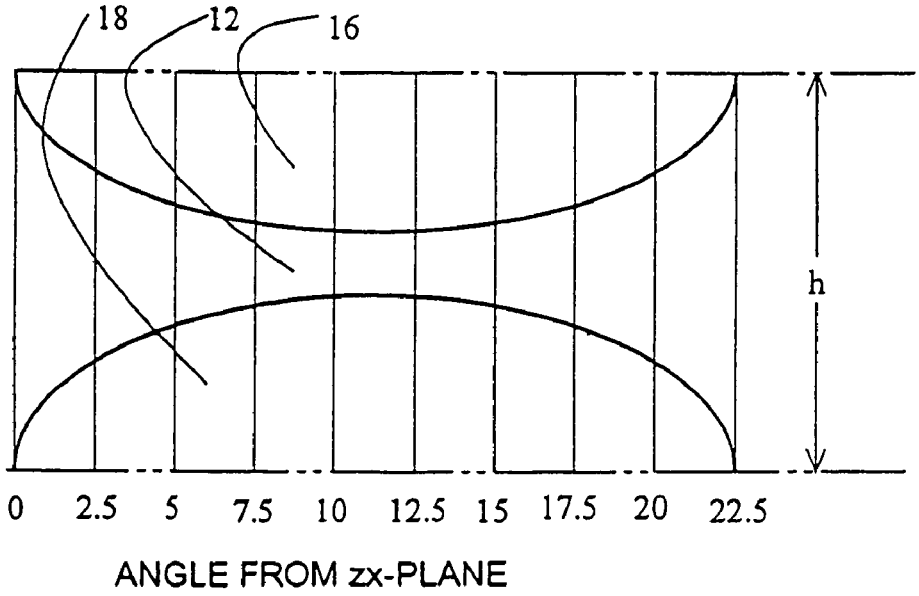
FIG. 17 is an enlarged side view of the girdle (outer surfaces) of the diamond of the present invention.

The lower limit of the girdle height (h) will be examined. Each of the upper girdle facets 16 in the crown intersects the girdle surface 12 so as to have a circular arc common with the girdle surface. The circular arc of the upper girdle facet 16 is convex in a downward direction. Each of the lower girdle facets 18 in the pavilion intersects the girdle surface 12 so as to have a circular arc common with the girdle surface 12. The circular arc of the lower girdle facet 18 is convex in an upward direction and is opposed to the circular arc of the upper girdle facet 16 on the girdle surface. FIG. 17 is a schematic enlarged diagram of a girdle surface portion showing the state of the circular arc of the upper girdle facet 16 and the circular arc of the lower girdle facet 18 being opposed to each other. As the girdle height (h) is reduced, the circular arc of the upper girdle facet 16 and the circular arc of the lower girdle facet 18 enter a state of being intersecting each other, and the girdle periphery is thereby cut and becomes different from the circle or polygon. If the girdle height (h) when the circular arc of the upper girdle facet and the circular arc of the lower girdle facet are brought into contact with each other is "minimum girdle height", the minimum girdle height is determined by the pavilion angle (p) and the crown angle (c), as shown in TABLE 1. However, when the girdle height (h) is equal to or larger than 0.026 in terms of the ratio to the girdle radius, the intersection line formed by the two circular arcs of the upper girdle facet and the lower girdle facet, intersecting slightly, is so small that the intersection can be ignored. As can be understood from the TABLE, the girdle height (h) is, preferably, 0.030 or larger in terms of the ratio to the girdle radius.

Thus, the girdle height (h) is 0.026 to 0.3 and, more preferably, 0.030 to 0.15 in terms of the ratio to the girdle radius.

TABLE 1

| | | | | |
|---|---|---|---|---|
| Crown angle (c) | 28.82 | 27.92 | 26 | 24 |
| Pavilion angle (p) | 38.25 | 38.5 | 39 | 39.5 |
| Minimum girdle height (h) | 0.0301 | 0.0297 | 0.0289 | 0.02780 |

Figure 18:
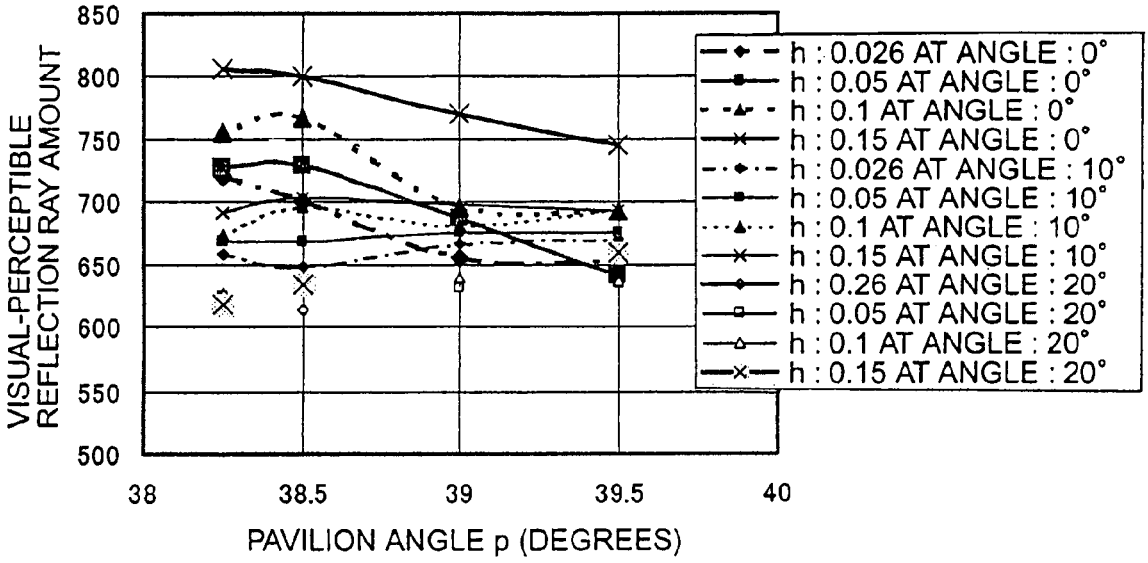
FIG. 18 is a graph showing the amount of visual-perceptible reflection rays from the diamonds of the present invention with respect to the pavilion angle (p) when the girdle height (h) is changed from 0.026 to 0.15.

The relationship between the girdle height (h) and the pavilion angle (p) was examined. A study was made by setting the girdle height (h) to 0.026, 0.05, 0.10 and 0.15 in terms of the ratio to the girdle radius and by increasing the pavilion angle (p) from 38.25 degrees to 39.5 degrees. The amount of visual-perceptible reflection rays when each of the diamonds was observed from a position above the table facet was measured with respect to sight line angles of 0, 10 and 20 degrees. FIG. 18 shows the result of this measurement. It can be understood from FIG. 18 that the amount of visual-perceptible reflection rays is increased if the girdle height (h) is increased, and that the amount of visual-perceptible reflection rays tends to decrease if the pavilion angle (p) is increased. However, with the increase in sight line angle from 0 to 10 degrees and from 10 to 20 degrees, this tendency is reduced. Also from this result, it can be understood that the features of the diamond with the round brilliant cut of the present invention can be recognized when the diamond is observed at a sight line angle smaller than 20 degrees.

Pavilion and Crown Angle Dependency in Visual-perceptible Reflection Rays

A study was made about the amount of visual-perceptible reflection rays while changing the pavilion angle (p) and the crown angle (c). The study was preliminarily made by examining changes in optical paths in diamonds when reflection rays along the z-axis direction were observed while changing the pavilion angle (p) and the crown angle (c). FIG. 15 schematically shows optical paths examined.

Thick solid lines extending upwardly through the right half of the table facet as illustrated in FIG. 15 indicate a region in which optical paths exist along which rays come in through the left crown facets, are reflected in the diamond, and come out through the right half of the table facet. Rays having similar optical paths exist between the optical paths indicated by the two thick solid lines. Thick broken lines extending upwardly through the right crown facets indicate a region in which optical paths exist along which rays come in through the left crown facets, are reflected in the diamond, and come out through the right crown facets. Rays having similar optical paths exist between the optical paths indicated by the two thick broken lines. Also thin solid lines extend upwardly through the right crown facets indicate a region in which optical paths exist along which rays come in at the left end of the table facet, are reflected in the diamond, and come out through the right crown facets. Rays having similar optical paths exist between the optical paths indicated by the two thin solid lines. In FIG. 15D, no optical paths are indicated by thick broken lines since the amount of rays coming in through the crown facet and coming out through the crown facet is small.

Figure 15A:
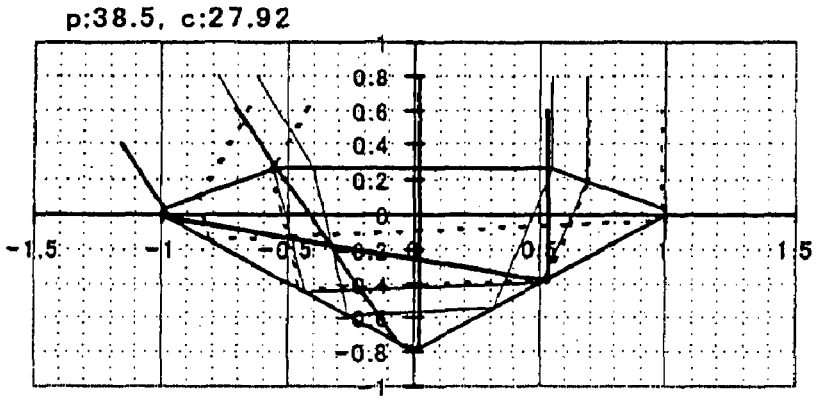
FIGS. 15A, 15B, 15C and 15D are diagrams each showing optical paths along which reflection rays travel to come out from the ornamental diamond in the z-axis direction, FIGS. 15A, 15B and 15C showing the optical paths in the diamond of the present invention with respect to different values of the crown angle, FIG. 15D showing the case of the conventional diamond.

FIG. 15A shows optical paths when a round brilliant cut diamond having a pavilion angle (p) of 38.5 degrees and a crown angle (c) of 27.92 degrees was observed along the z-axis direction on the table facet. Reflection rays coming out along the z-axis through the right-hand table-facet are rays which have come in through the left crown facets. Reflection rays coming out along the z-axis through portions of the right crown facets close to the girdle are rays which have come in through central portions of the left crown facets. Also, reflection rays coming out along the z-axis through portions of the right crown facets close to the table periphery are rays which have come in through portions of the left crown facets close to the periphery of the left-hand table facet.

Figure 15B:
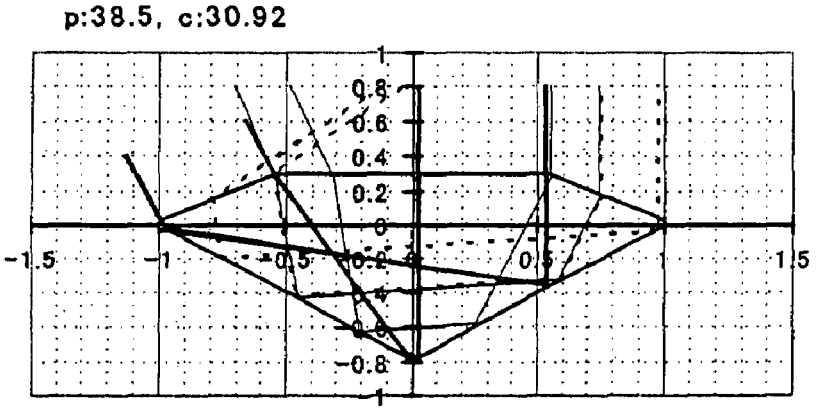

FIG. 15B shows optical paths along which reflection rays travel in a diamond having its crown angle (c) increased by 3 degrees to be set to 30.92 degrees while having the same pavilion angle (p), 38.5 degrees. Reflection rays coming out along the z-axis through portions of the right crown facets close to the girdle are rays which have come in through central portions of the left crown facets, as are those traveling along the optical paths shown in FIG. 15A. In this diamond, however, the incident angles are increased. Also, the area of incident rays is reduced. It is thought that the intensity of reflection rays is reduced for this reason. If the crown angle (c) is further increased, though not shown, the incident angle is further increased and criticality is reached when the crown angle (c) is 31.395 degrees, and rays do not come in through the crown facets to come out through the crown facets.

Figure 15C:
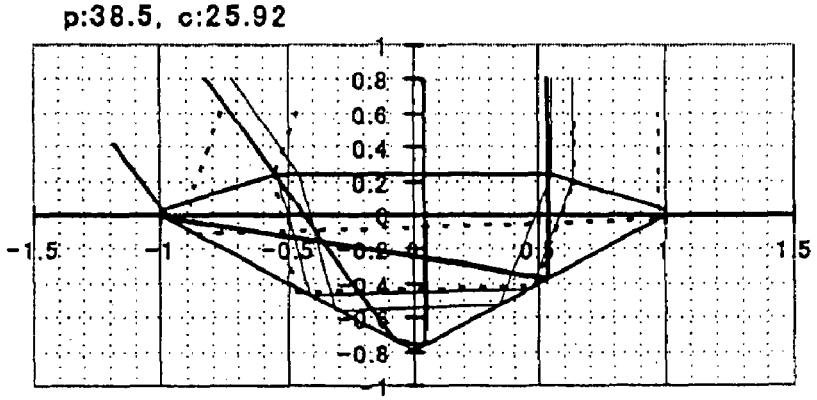

FIG. 15C shows optical paths along which reflection rays travel in a diamond having its crown angle (c) reduced by 2 degrees conversely to be set to 25.92 degrees while having the same pavilion angle (p), 38.5 degrees. Reflection rays coming out along the z-axis through the right-hand table facet are rays which have come in through the left-hand crown facets. However, rays coming out through a central area of the table facet are lost and the corresponding portion becomes dimmer.

Figure 15D:
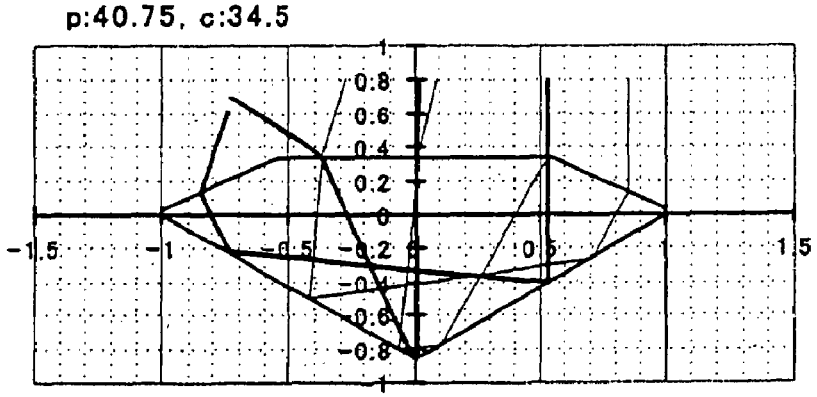

FIG. 15D shows, for comparison, optical paths, along which reflection rays travel in a diamond with a conventional cut design using a pavilion angle (p) of 40.75 degrees and a crown angle (c) of 34.5 degrees. Reflection rays coming out through the right-hand table facet are rays which have come in through portions between a position in the vicinity of the periphery of the left-hand table facet and a position in the left-hand crown facets. Reflection rays coming out through the right-hand crown facets are rays which have come in through a portion of the left-hand table facet in the vicinity of a center of the table facet.

A state in which the crown facets, i.e., bezel facets, of the diamond with the cut design in accordance with the present invention are brightly shining can be imaged from FIG. 15. In the diamond with the cut design in accordance with the present invention, however, the crown facets, i.e., bezel facets, become dimmer if the crown angle (c) is increased, as shown in FIG. 15B. If the crown angle is set to such a value that the incident angle is equal to or larger than a value corresponding to criticality, rays from the bezel facets are extremely weak. Therefore it is necessary to maintain the crown angle (c) below the value corresponding to its criticality. Since criticality of the incident angle is reached when the pavilion angle $p=1/4\times\{(\sin^{-1}(1/n)+\sin^{-1}(1/n-\sin c))\times 180/\pi+180-2c\}$ (where n is the refractive index of the diamond, $\pi$ is the circular constant, and the pavilion angle (p) and the crown angle (c) are expressed in degrees (°)), each of the crown angle (c) and the pavilion angle (p) must be in such a range that $p<1/4\times\{(\sin^{-1}(1/n)+\sin^{-1}(1/n\cdot\sin c))\times 180/\pi+180-2c\}$ is satisfied.

Figure 19:
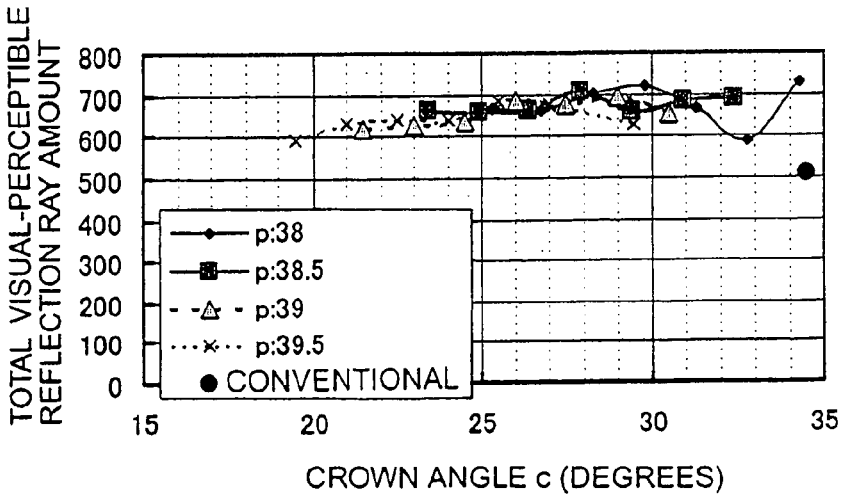
FIG. 19 is a graph showing the total visual-perceptible reflection ray amount from the diamonds of the present invention (pavilion angle (p): 38, 38.5, 39 and 39.5 degrees) with respect to the crown angle (c)
Figure 20:
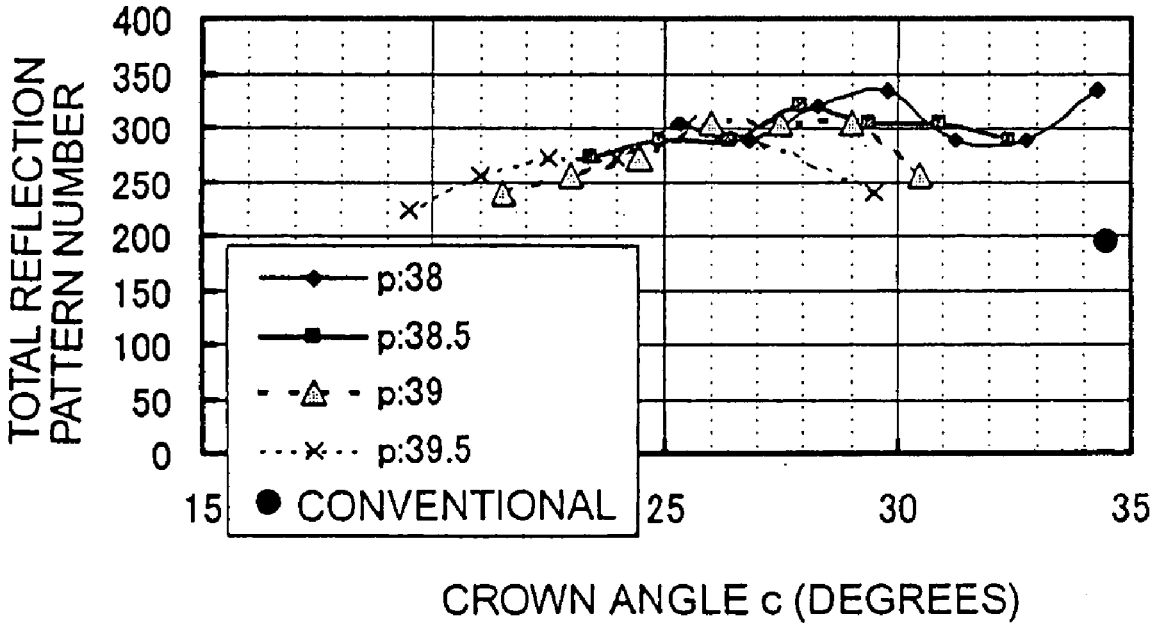
FIG. 20 is a graph showing the total number of reflection ray patterns from the diamonds of the present invention (pavilion angle (p): 38, 38.5, 39 and 39.5 degrees) with respect to the crown angle (c)

To examine the effective ranges of the pavilion angle (p) and the crown angle (c), the amounts of visual-perceptible reflection rays and the numbers of patterns in the case of observation along the z-axis were examined by setting the pavilion angle (p) to 38, 38.5, 39, and 39.5 degrees, and by changing the crown angle (c) between 25.3 and 34.3 degrees, between 23.42 and 42 degrees, between 21.5 and 30.5 degrees, or between 19.5 and 29.5 degrees with respect to each of the values of the pavilion angle (p). FIGS. 19 and 20 show the relationship between the total amount of visual-perceptible reflection rays and the crown angle (c) and the relationship between the total number of patterns and the crown angle (c) with respect to reflection rays based on all incident rays coming in through the crown facets (including the girdle surfaces) and the table facet, the pavilion angle (p) being used as a parameter. Each of the diamonds in which each of the pavilion angle and the crown angle is within the above-described range has an amount of visual-perceptible reflection rays larger than 588, while a diamond with a conventional cut design (pavilion angle (p): 40.75 degrees; crown angle (c): 34.5 degrees) has an amount of visual-perceptible reflection rays of 507. Thus, the amount of visual-perceptible reflection rays from each diamond of the present invention is larger than that from the conventional diamond. Also, with respect to any of the pavilion angles and crown angles, the number of patterns of each diamond of the present invention is larger than the number of patterns of the diamond with the conventional cut design, which is 192.

Introduction of Effective Visual-perceptible Reflection Rays

When an observer observes a diamond in a direction toward the table facet, rays coming from a position just at the back of the observer are blocked by the observer and do not enter the diamond. Also, rays incident on a diamond at an angle equal to or larger than 45 degrees from the z-axis do not effectively contribute to the formation of reflection ray patterns, i.e., the brilliancy of the diamond, as described above with reference to FIGS. 10 and 11. In a case where a diamond is observed from a position above the table facet (along the z-axis direction), the amount of visual-perceptible reflection rays formed by rays coming in through the crown facets and the table facet of the diamond in the angular range from 20 to 45 degrees with the z-axis effectively contributes to the brilliancy of the diamond. Therefore, the amount of visual-perceptible reflection rays obtained in this manner will be referred to as an amount of effective visual-perceptible reflection rays.

Figure 21:
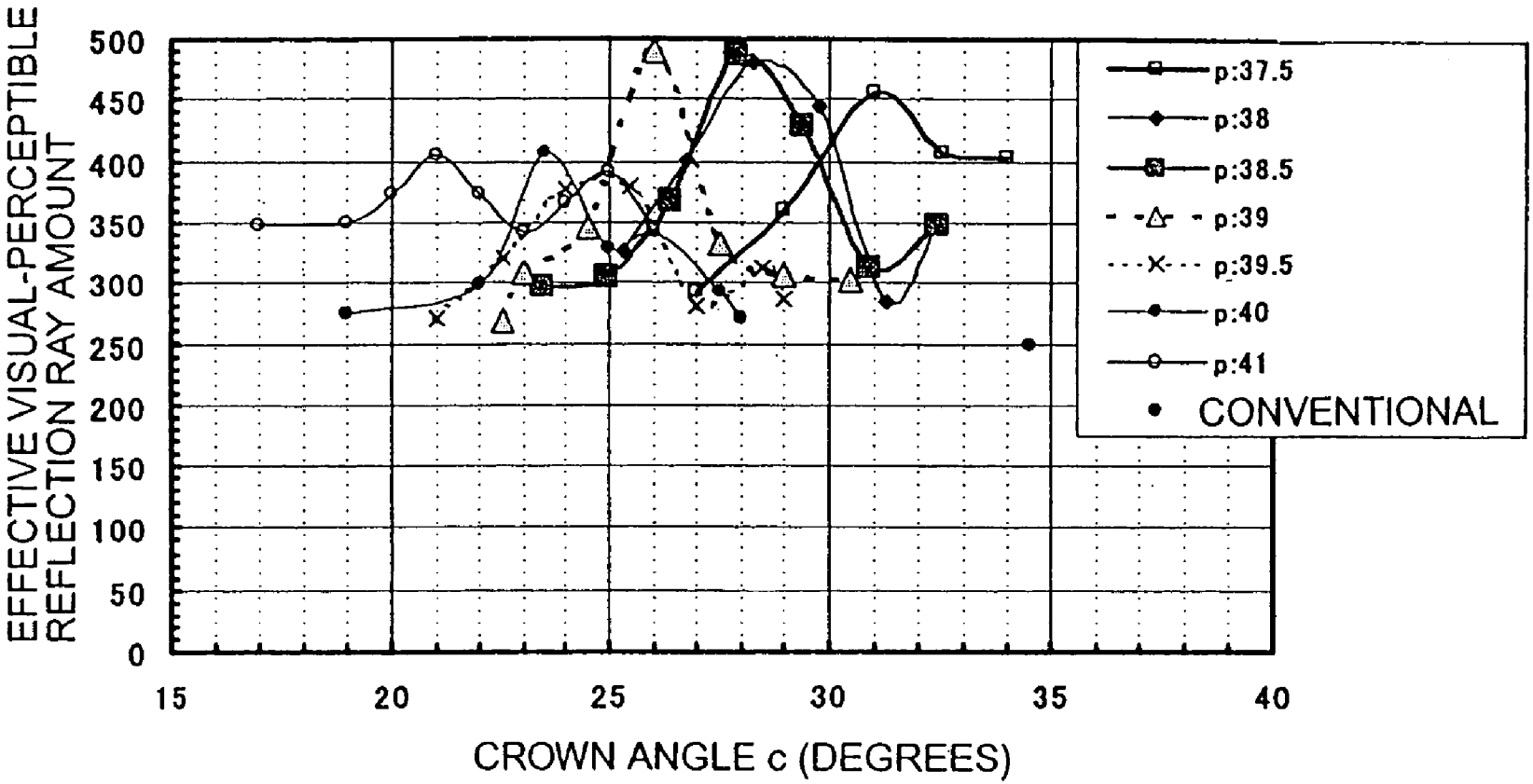
FIG. 21 is a graph showing the effective visual-perceptible reflection ray amount from the diamonds of the present invention (pavilion angle (p): 37.5, 38, 38.5, 39, 39.5, 40 and 41 degrees) with respect to the crown angle (c)

FIG. 21 shows the results of an examination made on the amount of effective visual-perceptible reflection rays by changing the crown angle (c) with respect to different values of the pavilion angles (p): 37.5, 38, 38.5, 39, 39.5, 40 and 41 degrees. The amount of effective visual-perceptible reflection rays of a diamond with a conventional cut design is about 250. When the pavilion angle (p) is 37.5 degrees, a maximum amount of effective visual-perceptible reflection rays is obtained by setting the crown angle (c) to 31 degrees. By setting the crown angle (c) in the range from 27 to 34 degrees, an amount of effective visual-perceptible reflection rays of about 300 or larger is obtained. When the pavilion angle (p) is 38 degrees, a maximum amount of effective visual-perceptible reflection rays is obtained by setting the crown angle (c) to 28.3 degrees. In this case, even when the crown angle (c) is set to 25.3 degrees, an amount of effective visual-perceptible reflection rays of 320 or larger is obtained. However, if the crown angle (c) is increased to 31.3 degrees, the amount of effective visual-perceptible reflection rays becomes considerably small. This may be because criticality of incident rays coming in through the crown facets with respect to reflection rays emergent through the crown facets is reached when the crown angle (c) is about 32.6 degrees described above with reference to FIG. 15B. In some case, as the crown angle is further increased, the amount of effective visual-perceptible reflection rays is temporarily increased. In such a case, however, the amount of effective visual-perceptible reflection rays is reduced when the crown angle is further increased. When the crown angle (c) is 34.3 degrees, the amount of effective visual-perceptible reflection rays is 211. In this state, the brilliancy of the diamond of the present invention becomes lower than that of the conventional diamond.

When the pavilion angle (p) is 38.5 degrees, a maximum amount of effective visual-perceptible reflection rays is obtained by setting the crown angle (c) to 27.92 degrees. As the crown angle (c) is further increased from this value, the amount of reflection rays is reduced and is minimized when the crown angle (c) is 30.92 degrees. This may be because criticality of the incident angle of rays incident on the crown facets is reached when the crown angle (c) is about 31.4 degrees. When the crown angle (c) becomes smaller than 27.92 degrees, the amount of reflection rays is also reduced. When the crown angle is equal to or smaller than 25 degrees, the amount of effective visual-perceptible reflection rays is about 300. When the crown angle (c) is equal to or larger than 23 degrees, the amount of effective visual-perceptible reflection rays of the diamond of the present invention is larger than that of the conventional one.

When the pavilion angle (p) is 39 degrees, a maximum amount of effective visual-perceptible reflection rays is obtained by setting the crown angle (c) to 26 degrees. As the crown angle (c) is increased from this value, the amount of effective visual-perceptible reflection rays is reduced. When the crown angle (c) is 30.5 degrees, the amount of effective visual-perceptible reflection rays is about 300. It is thought that criticality of the incident angle of rays incident on the crown facets is reached when the crown angle (c) is about 30.2 degrees. Conversely, as the crown angle is reduced from 26 degrees, the amount of effective visual-perceptible reflection rays becomes smaller. When the crown angle (c) is 23 degrees, the amount of effective visual-perceptible reflection rays is about 300. When the crown angle (c) is smaller than this value, the amount of effective visual-perceptible reflection rays is further reduced. When the crown angle (c) is equal to or larger than 22.5 degrees, the amount of effective visual-perceptible reflection rays of the diamond of the present invention is larger than that of the conventional one.

When the pavilion angle (p) is 39.5 degrees, the amount of effective visual-perceptible reflection rays is generally reduced. When the crown angle (c) is in the vicinity of 25 degrees, the amount of effective visual-perceptible reflection rays is maximized but its value is about 380. As the crown angle (c) is increased from this value, the amount of reflection rays is reduced. Also, as the crown angle (c) is reduced from that value, the amount of reflection rays is reduced. When the crown angle (c) is about 20 degrees, the amount of effective visual-perceptible reflection rays of the diamond of the present invention is smaller than that of the conventional one. Therefore, to set the amount of reflection rays to 270 or larger with a sufficient margin in comparison with 250, i.e., the amount of reflection rays from the conventional diamond, it is necessary to set the crown angle to 21 degrees or larger. However, the amount of effective visual-perceptible reflection rays when the pavilion angle (p) is 40 degrees is substantially equal to that when the pavilion angle (p) is 39.5 degrees, and the crown angle (c) corresponding to the maximum thereof is smaller than that when the pavilion angle (p) is 39.5 degrees. Therefore, if the crown angle (c) is slightly reduced, high brilliancy based on a large amount of effective visual-perceptible reflection rays can be observed even when the pavilion angle (p) is 40 degrees. Also, the amount of effective visual-perceptible reflection rays when the pavilion angle (p) is 41 degrees is not considerably reduced even when the crown angle is reduced. Thus, it can be understood that preferable results can be obtained if the pavilion angle (p) is not larger than 41 degrees.

Conversely, when the pavilion angle (p) is smaller than 37.5 degrees, rays entering an upper portion of the crown main facets (bezel facets), i.e., a portion close to the table periphery, leak to the back of the diamond through a portion in the vicinity of the culet. There is a possibility of an upper portion of the bezel facets or star facets becoming dimmer in observation from a position above the table of the diamond along the z-axis. It is, therefore, necessary that the pavilion angle (p) be 37.5 degrees or larger.

Figure 22:
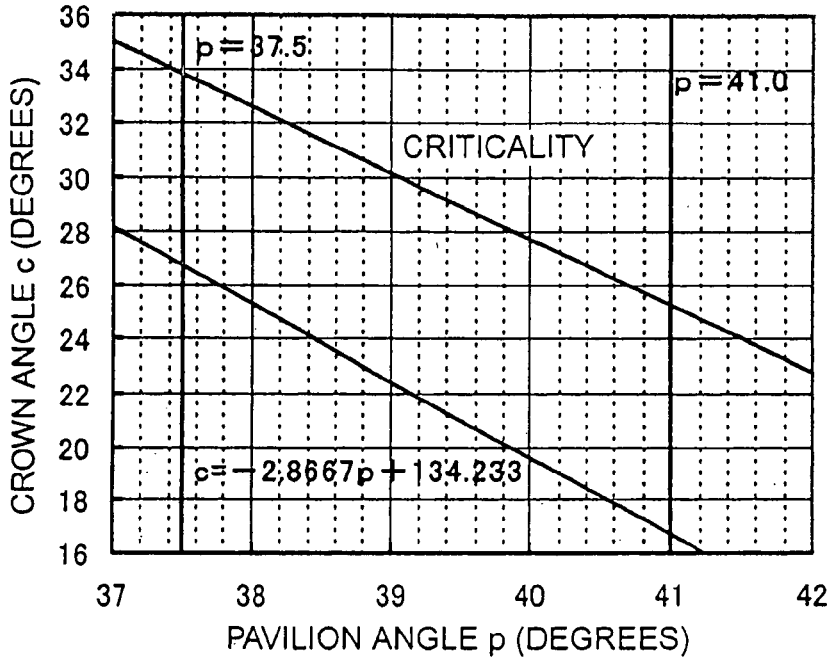
FIG. 22 is a graph showing a region of the pavilion angle (p) and the crown angle (c) enhancing the amount of effective visual-perceptible reflection rays.

From the viewpoint of the amount of effective visual-perceptible reflection rays, it is necessary to set the crown angle (c) to 25.3 degrees or larger when the pavilion angle (p) is 38 degrees, and to set the crown angle (c) to 21 degrees or larger when the pavilion angle (p) is 39.5 degrees. A straight line connecting the point corresponding to a crown angle (c) of 25.3 degrees at the pavilion angle (p) of 38 degrees and the point corresponding to a crown angle (c) of 21 degrees at the pavilion angle (p) of 39.5 degrees in accordance with the most severe requirement of the amount of effective visual-perceptible reflection rays is $c=-2.8667\times p+134.233$. Crown angles c larger than the straight line of the equation, the relational expression $p<1/4\times\{(\sin^{-1}(1/n)+\sin^{-1}(1/n-\sin c))\times 180/\pi+180-2c\}$ defining a condition for maintaining the incident angle below criticality, and the condition requiring setting of the pavilion angle (p) to 37.5 to 41 degrees are plotted together in the graph of FIG. 22. When the pavilion angle (p) and the crown angle (c) are in the region surrounded by the four straight lines shown in FIG. 22, the amount of effective visual-perceptible reflection rays is sufficiently larger and a highly brilliant diamond can be obtained.

Figure 23:
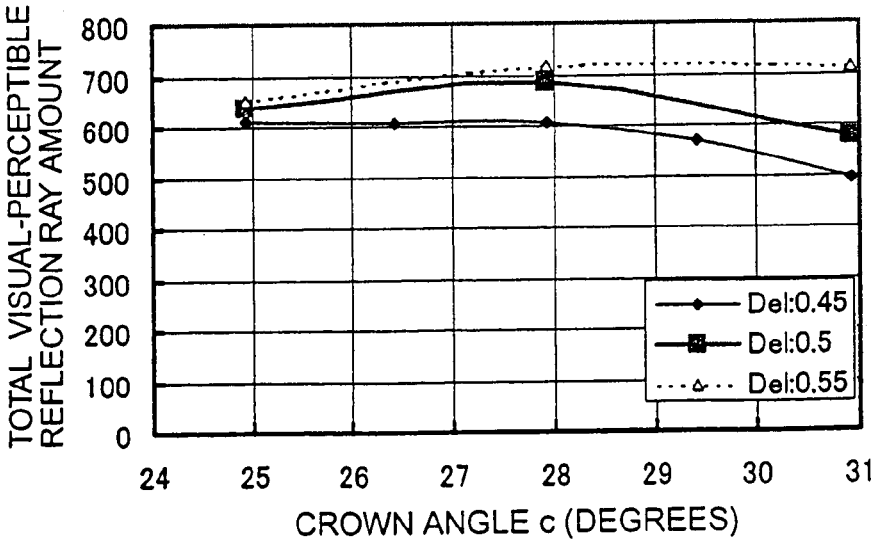
FIG. 23 is a graph showing the total amount of visual-perceptible reflection rays from the diamonds of the present invention with respect to the crown angle (c) when the table diameter (Del) is 0.45, 0.5 and 0.55.
Figure 24:
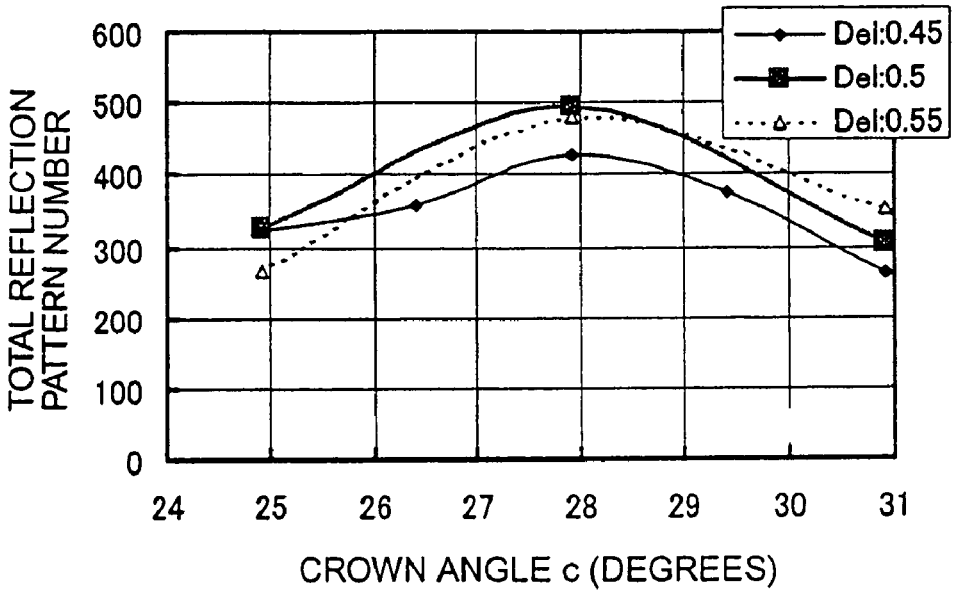
FIG. 24 is a graph showing the total number of reflection ray patterns from the diamonds of the present invention with respect to the crown angle (c) when the table diameter (Del) is 0.45, 0.5 or 0.55.
Figure 25:
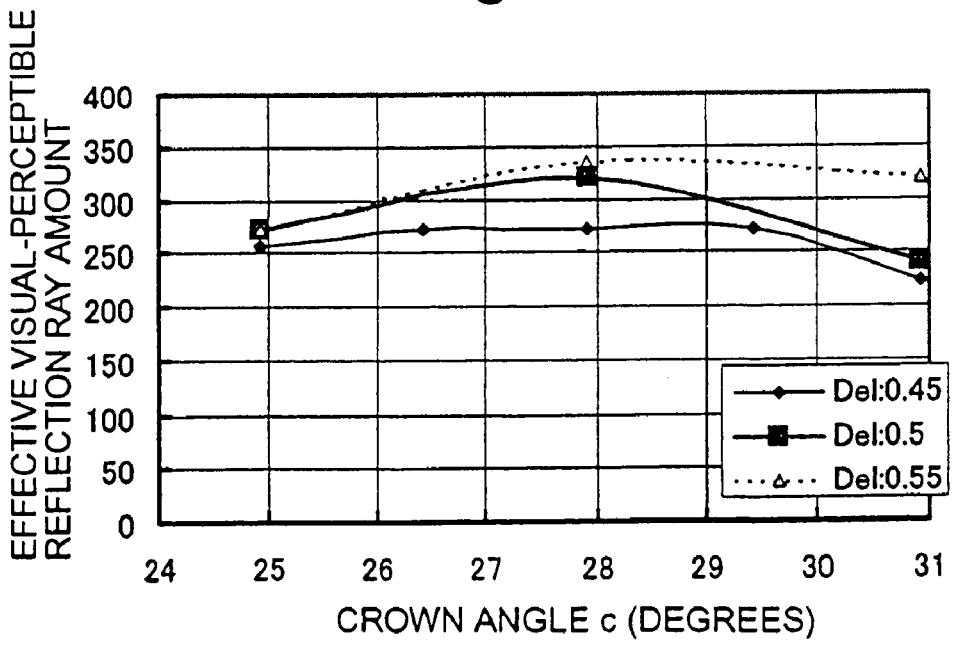
FIG. 25 is a graph showing the effective visual-perceptible reflection ray amount from the diamonds of the present invention with respect to the crown angle (c) when the table diameter (Del) is 0.45, 0.5 or 0.55.

Relationship Between Table Diameter and Effective Visual-perceptible Reflection Rays The influence of the table diameter (Del) on the amount of effective visual-perceptible reflection rays was examined. With respect to diamonds in which the pavilion angle (p) is set to 38.5 degrees and the table diameter (Del) to 0.45, 0.5 and 0.55 in terms of the ratio to the diameter of the girdle, the total amount of visual-perceptible reflection rays, the total number of reflection patterns and the amount of effective visual-perceptible reflection rays were obtained while changing the crown angle (c) from 24.92 to 30.92 degrees. The obtained values are shown in FIGS. 23, 24 and 25. When the table diameter is 0.5 or 0.55 in terms of the ratio to the diameter of the girdle, each of the total amount of visual-perceptible reflection rays, the total number of reflection patterns and the amount of effective visual-perceptible rays is larger than the corresponding value of the diamond in which the table diameter is 0.45. It is necessary that the table diameter be 0.45 or larger in terms of the ratio to the diameter of the girdle. In comparison between the diamonds having the table diameters set to 0.5 and 0.55, each of the total amount of visual-perceptible reflection rays and the amount of effective visual-perceptible reflection rays is not substantially increased by setting the table diameter to 0.55. Disadvantageously, the number of reflection patterns tends to decrease if the table diameter is changed from 0.5 to 0.55. Limitation of the table diameter to 0.60 is thought to be preferable. In the diamond with the cut design in accordance with the present invention, the brilliancy of the bezel facets is higher than that of the table facet. From the viewpoint of increasing the size of the bezel facets, limitation of the table diameter to a comparatively small value is preferred.

Application to Modified Round Brilliant Cut

The cut design of the ornamental diamond in accordance with the present invention has been described with respect to an ordinary round brilliant cut. In the ordinary round brilliant cut, upper girdle facets 16 and two lower girdle facets 18 are opposed to each other with a girdle 12 interposed therebetween, and bezel facets 14 and pavilion main facets 17 are also opposed to each other in a similar manner, as shown in FIGS. 1 and 2. In the diamond having the ordinary round brilliant cut, a ray entering a bezel facet 14 strikes a pavilion main facet 17, is reflected by the same, strikes the pavilion main facet 17 on the opposite side, is reflected by the same, and exits through a bezel facet 14 or the table facet 11.

Figure 26A:
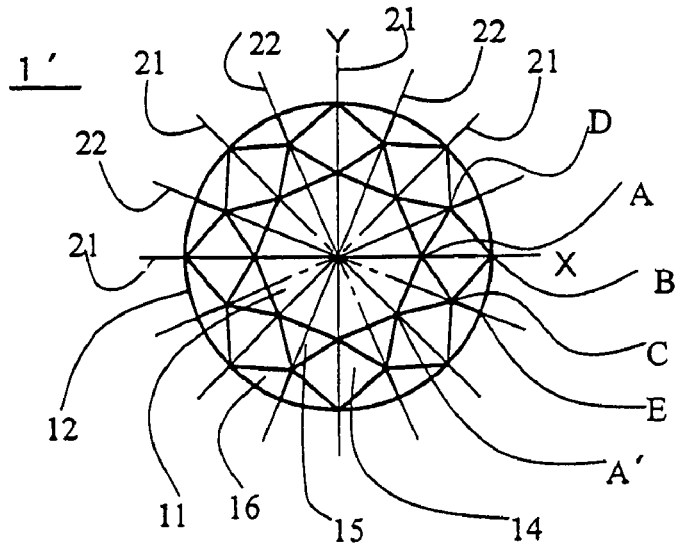
FIGS. 26A, 26B and 26C are a top view, a side view and a bottom view, respectively, of an ornamental diamond having a modified round brilliant cut in accordance with the present invention.
Figure 26B:
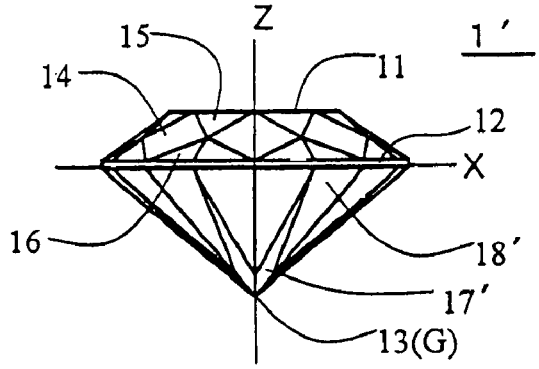
Figure 26C:
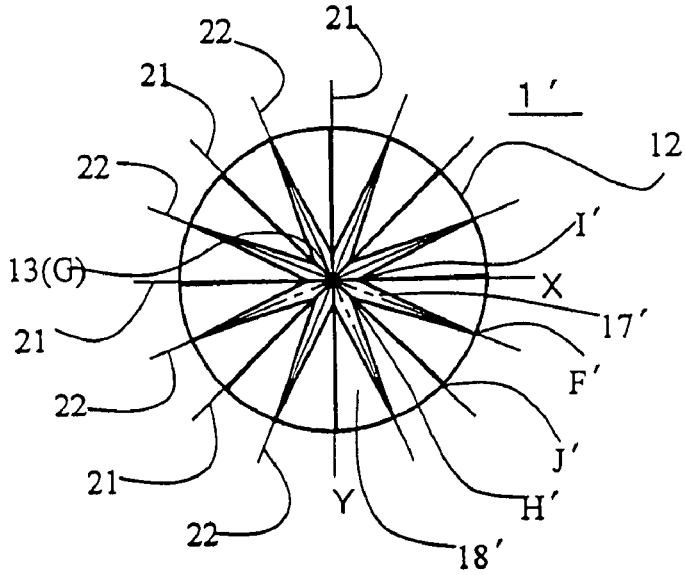

The cut design of the ornamental diamond of the present invention can be applied to a modified round brilliant cut, such as shown in FIG. 26. This modified round brilliant cut is formed in such a manner that either the crown or the pavilion in the ordinary round brilliant cut shown in FIG. 1 is turned by 22.5 degrees about the z-axis. In FIG. 26 showing a diamond 1' having a round brilliant cut modified from that shown in FIG. 1, FIG. 26A is a top view, FIG. 26B is a side view, and FIG. 26C is a bottom view.

The diamond 1' having the modified round brilliant cut has portions corresponding to those of the diamond 1 having the ordinary round brilliant cut. That is, the diamond 1' has: a girdle 12 having a substantially circular or polygonal shape; a crown in the form of a nearly polygonal truncated pyramid formed upward above the girdle 12; a regular octagonal table facet 11 forming a top surface of the polygonal truncated pyramid; and a pavilion in the form of a nearly polygonal pyramid formed downward below the girdle.

Referring to FIG. 26, showing the diamond 1' having the modified round brilliant cut, a straight line passing through a center of the table facet and the center apex of the pavilion polygonal pyramid will be referred to as a center axis (z-axis); each of planes containing the center axis and the vertexes of the regular octagon of the table facet will be referred to as a first plane 21; and a plane passing through the center axis and bisecting the angle formed between adjacent two of the first planes 21 will be referred to as a second plane 22, as are those shown in FIG. 1.

The crown of the diamond having the modified round brilliant cut is the same as that of the ordinary round brilliant cut diamond as shown in FIG. 1, and has eight crown main facets 14, eight star facets 15, and sixteen upper girdle facets 16. Also, the pavilion has eight pavilion main facets 17' and sixteen lower girdle facets 18'.

Each crown main facet 14 is a rectangular plane surface or a kite-shaped surface having two opposite vertexes, one coinciding with one of the vertexes of the regular octagonal table facet 11 (e.g., vertex A shown in FIG. 26A) and the other being a cross point B at which the first plane 21 containing the vertex A (e.g., the zx-plane) intersects the upper periphery of the girdle 12. The rectangular plane surface has other two opposite vertexes each positioned on the neighboring second plane 22 and has one vertex C or D common with each of the neighboring crown main facets 14. Each star facet 15 is a triangle AA'C defined by one side AA' of the regular octagonal table facet 11 and by one vertex coinciding with the common vertex C of the two neighboring crown main facets 14 respectively having vertexes coinciding with the opposite end points A and A' of the side. Each upper girdle facet 16 is a triangle defined by one side (e.g., CB) intersecting at its one end the upper periphery of the girdle 12 among the sides of one crown main facet 14, and by a point E at which the second plane 22 containing the other end C of the side intersects the upper periphery of the girdle 12.

Referring to FIG. 26C, each pavilion main facet 17' is a rectangular plane surface or a kite-shaped surface having two opposite vertexes, one coinciding with a point F' at which one of the second planes 22 intersects the lower periphery of the girdle 12, and the other coinciding with a center apex G of the pavilion polygonal pyramid. The rectangular plane surface has other two opposite vertexes H' and I' each positioned on the neighboring first plane 21 and has one side GH' or GI' and one vertex H' or I' common with each of the neighboring pavilion main facets 17'. Each lower girdle facet 18' is a plane defined by one side (e.g., F'H') intersecting at one end the lower periphery of the girdle 12 among the sides of one pavilion main facet 17', and by a point J' at which the first plane 21 containing the other end H' of the side intersects the lower periphery of the girdle 12. The description is made here without mentioning a culet 13.

In the diamond 1' having the modified round brilliant cut, the upper girdle facets 16 and the lower girdle facets 18' located at upper and lower positions with the girdle 12 interposed therebetween are opposite to each other, as shown in FIG. 26. However, because of turning by 22.5 degrees, the lower girdle facets 18' are placed at positions corresponding to the bezel facets 14, and the pavilion main facets 17' are not placed in correspondence with the bezel facets 14. Therefore, rays entering one bezel facet 14 are reflected by the lower girdle facets 18', and the reflected rays strike the lower girdle facets 18' on the opposite side, are reflected by the same, and exit through the bezel facets 14 in the crown or through the table facet 11.

Figure 27:
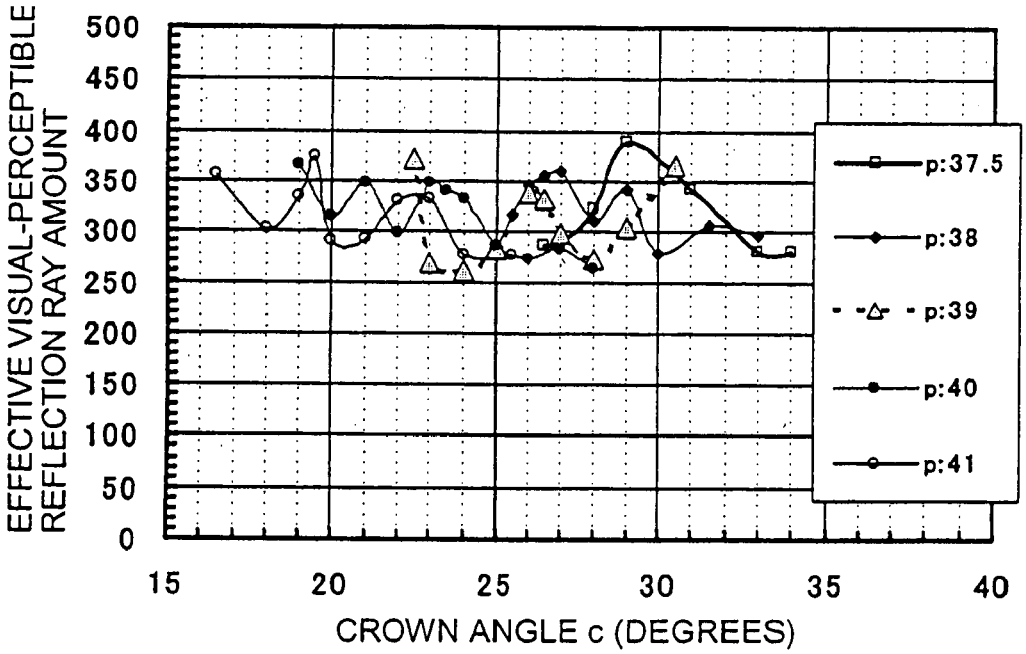
FIG. 27 is a graph showing the amount of effective visual-perceptible reflection rays from the modified round brilliant cut diamonds (pavilion angle (p): 37.5, 38, 39, 40 and 41 degrees) with respect to the crown angle (c)
Figure 28:
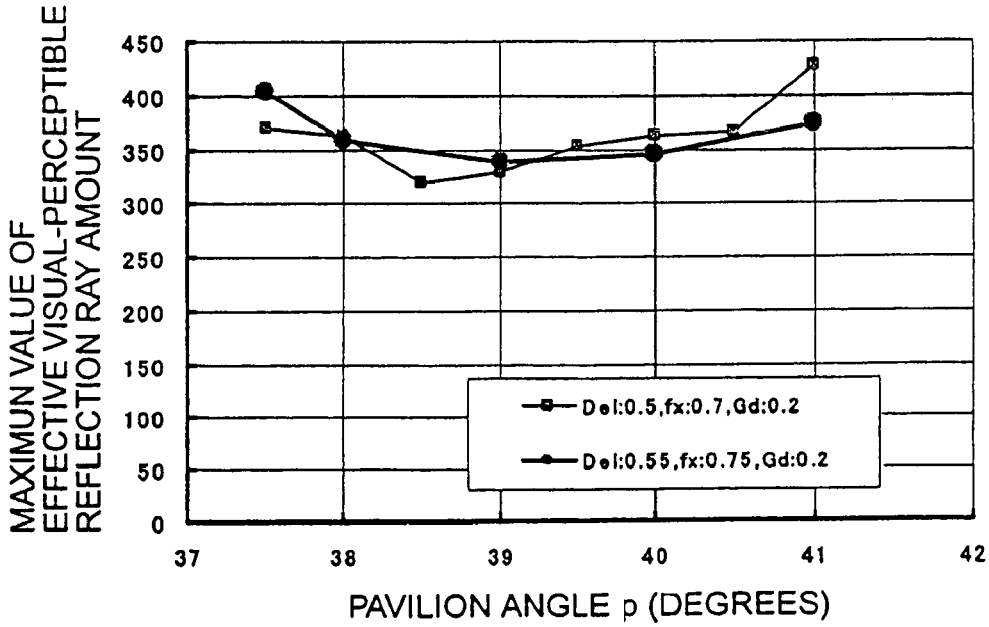
FIG. 28 is a graph showing the maximum value of the effective visual-perceptible reflection ray amount from the modified round brilliant cut diamonds having table diameters (Del) of 0.5 and 0.55 with respect to the pavilion angle (p)

FIG. 27 shows the results of measurement of the amount of effective visual-perceptible reflection rays from the diamond 1' having the modified round brilliant cut made by changing the crown angle with respect to different values of the pavilion angle p: 37.5, 38, 39, 40 and 41 degrees. It can be understood from FIG. 27 that the amount of effective visual-perceptible reflection rays of the modified round brilliant cut diamond having a pavilion angle (p) and the crown angle (c) in the region surrounded by the four straight lines shown in FIG. 22 (crown angle (c) is 26.7 to 33.8 degrees at pavilion angle (p) of 37.5 degrees; crown angle (c) is 25.3 to 32.6 degrees at pavilion angle (p) of 38 degrees; crown angle (c) is 22.6 to 30.2 degrees at pavilion angle (p) of 39 degrees; crown angle (c) is 19.5 to 27.7 degrees at pavilion angle (p) of 40 degrees; and crown angle (c) is 16.7 to 25.3 degrees at pavilion angle (p) of 41 degrees) is larger than that (about 250) of the effective visual-perceptible reflection rays of a diamond with a conventional cut design. FIG. 28 shows a plot of the maximum values of the effective visual-perceptible reflection rays with respect to the values of the pavilion angle (p). In FIG. 28, the maximum values of the amount of effective visual-perceptible reflection rays of a round brilliant cut diamond of a modified design having a table diameter (Del) of 0.5, a star facet end distance (fx) of 0.7, a lower girdle facet vertex distance (Gd) of 0.2, and a girdle height (h) of 0.05 are also plotted. As can be understood from FIGS. 27 and 28, the modified round brilliant cut diamond has an advantageously large amount of effective visual-perceptible reflection rays in the pavilion angle ranges and crown angle ranges in accordance with the present invention. It can also be understood that even when the table diameter and the star facet end distance are slightly changed, the amount of rays is not substantially changed.

Figure 29:
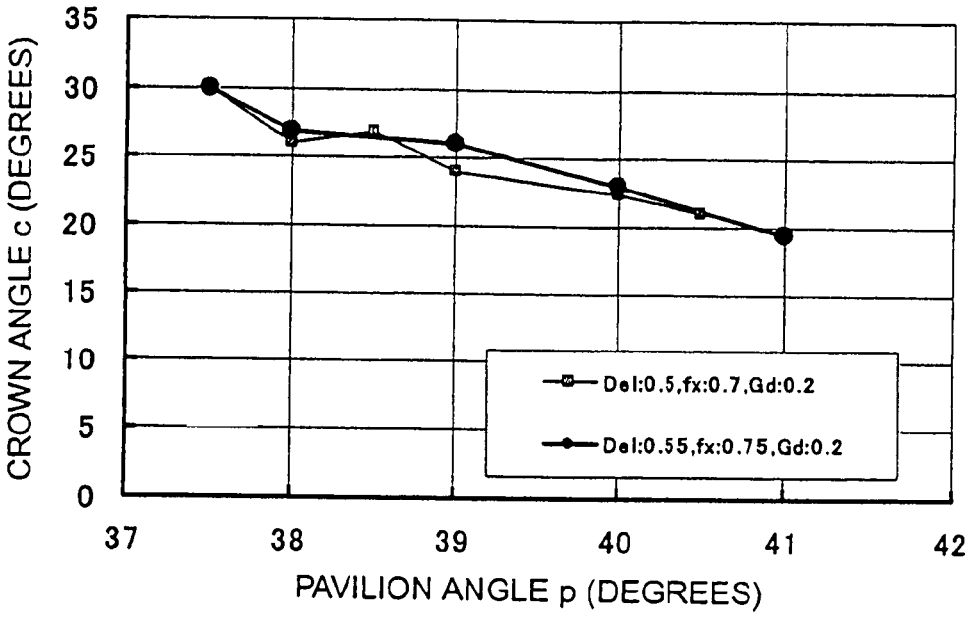
FIG. 29 is a graph showing the relationship between the pavilion angle (p) and the crown angle (c) maximizing the amount of the effective visual-perceptible reflection rays from the modified round brilliant cut diamonds having table diameters (Del) of 0.5 and 0.55.

FIG. 29 shows the pavilion angle (p) and the crown angle (c) of modified round brilliant cut diamonds with the design maximizing the amount of effective visual-perceptible reflection rays in a case where the table diameter (Del) is 0.5, the star facet end distance (fx) is 0.7, the lower girdle facet vertex distance (Gd) is 0.2, and the girdle height (h) is 0.05, and a case where the table diameter (Del) is 0.55, the star facet end distance (fx) is 0.75, the lower girdle facet vertex distance (Gd) is 0.2, and the girdle height (h) is 0.05. It can be understood that the maximum value of the amount of effective visual-perceptible reflection rays is maintained with respect to the same pavilion angle (p) and crown angle (c) even when the table diameter (Del) is changed from 0.55 to 0.5.

Figure 30:
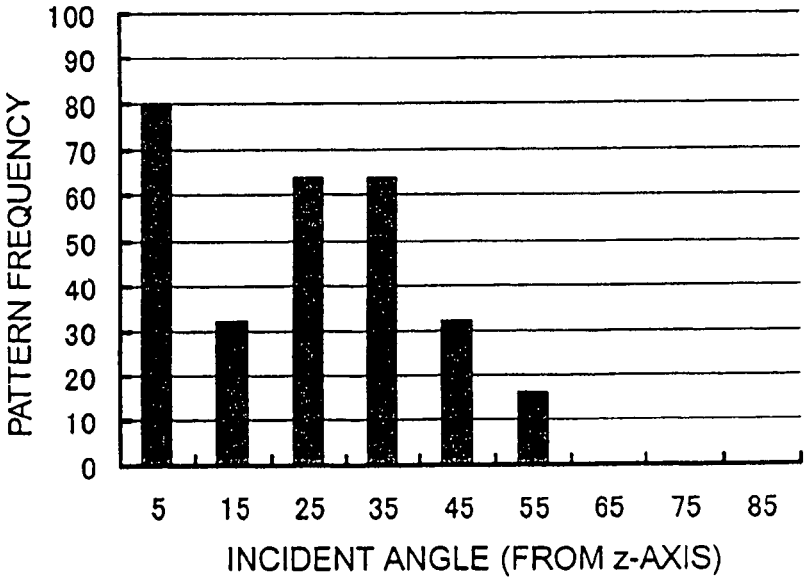
FIG. 30 is a histogram showing the pattern frequency at a sight line angle of 0 degree with respect to the incident angle (from the z-axis) of the modified brilliant cut diamond (table diameter (Del): 0.55; star facet end distance (fx): 0.75; lower girdle facet vertex distance (Gd): 0.2; girdle height (h): 0.05; pavilion angle (p): 40°; crown angle (c): 23°)

FIG. 30 shows the frequency of reflection ray patterns obtained from incident rays at incident angles in 10° steps from the z-axis when the modified round brilliant cut diamond in accordance with the present invention (table diameter (Del): 0.55; star facet end distance (fx): 0.75; lower girdle facet vertex distance (Gd): 0.2; girdle height (h): 0.05; pavilion angle (p): 40°; crown angle (c): 23°) was observed from a position right above the diamond in the z-axis direction (sight line angle of 0 degree). There are substantially no patterns resulting from incident rays at large incident angles equal to or larger than 60 degrees and most of the patterns appear in correspondence with the incident angle range from 10 to 50 degrees or 20 to 45 degrees. One peak appears in correspondence with an incident angle equal to or smaller than 10 degrees. However, rays at this incident angle come in the direction from the back of the observer and substantially no pattern results from them.

Figure 31:
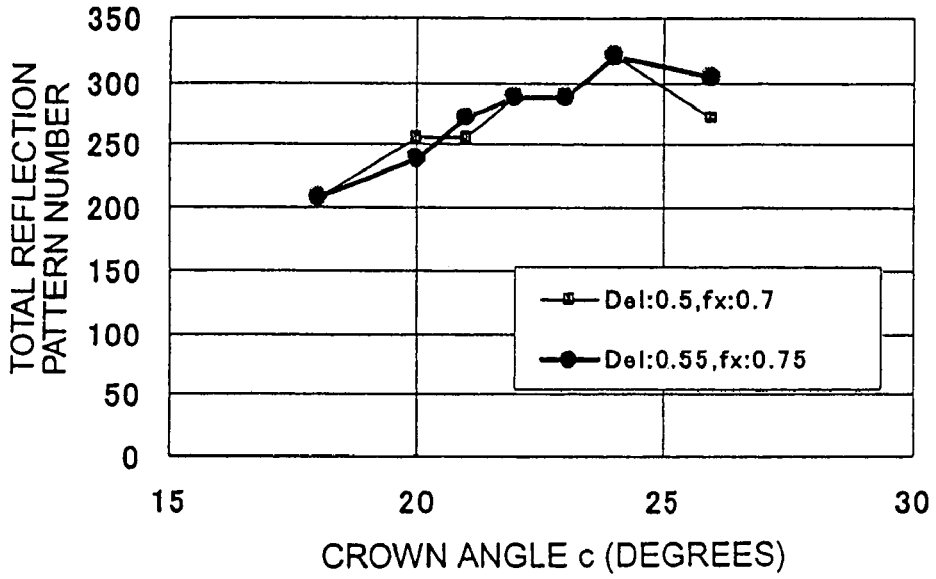
FIG. 31 is a graph showing the total number of reflection ray patterns from the modified round brilliant cut diamonds of the present invention having table diameters (Del) of 0.5 and 0.55 with respect to the crown angle (c)
Figure 32:
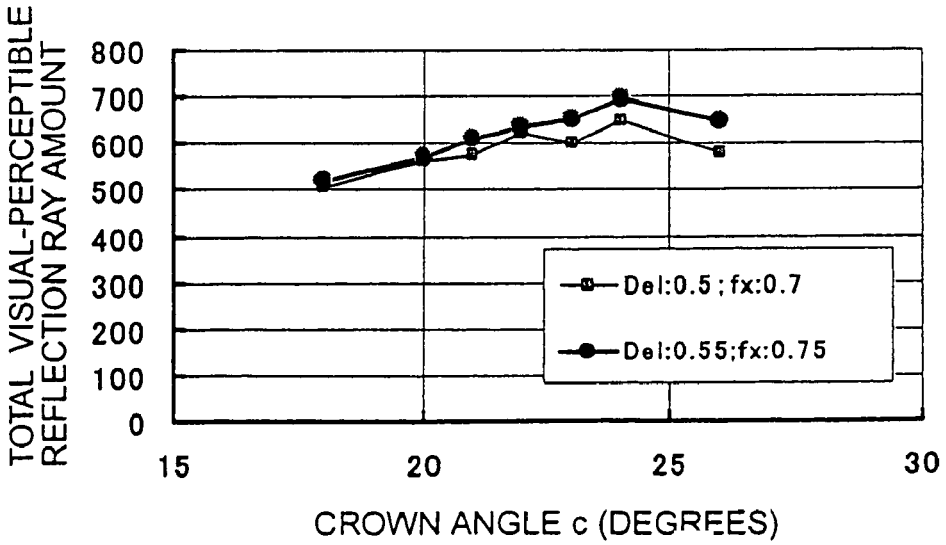
FIG. 32 is a graph showing the total amount of visual-perceptible reflection rays from the modified round brilliant cut diamonds of the present invention having table diameters (Del) of 0.5 and 0.55 with respect to the crown angle (c)
Figure 33:
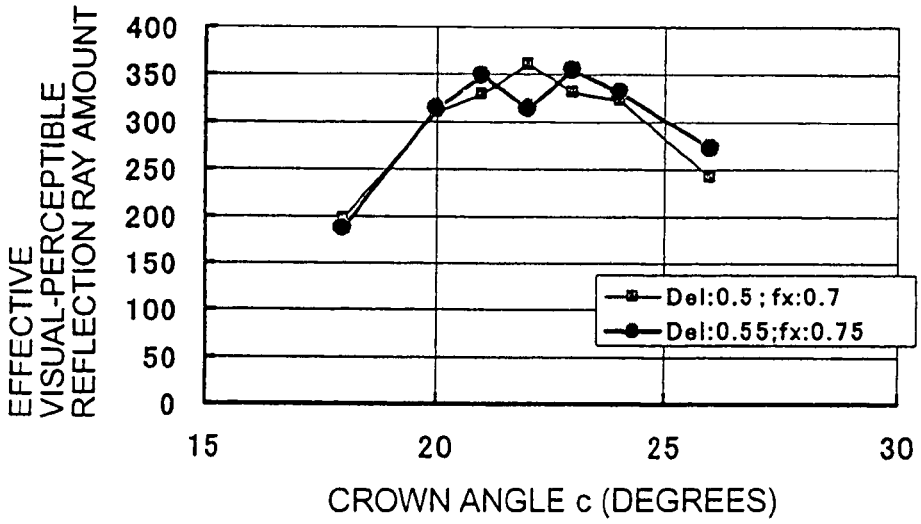
FIG. 33 is a graph showing the effective visual-perceptible reflection ray amount from the modified round brilliant cut diamonds of the present invention having table diameters (Del) of 0.5 and 0.55 with respect to the crown angle (c)

FIGS. 31, 32 and 33 show the results of measurement of the total number of patterns, the total amount of visual-perceptible reflection rays, and the amount of effective visual-perceptible reflection rays of the round brilliant cut diamond in accordance with the present invention having a table diameter (Del) of 0.5 (fx: 0.7; Gd: 0.2; h: 0.05; p: 40°) and the round brilliant cut diamond in accordance with the present invention having a table diameter (Del) of 0.55 (fx: 0.75; Gd: 0.2; h: 0.05; p: 40°) with respect to different values of the crown angle (c). These graphs respectively correspond to FIGS. 24, 23 and 25 of ordinary round brilliant cut diamonds, and the values shown in these graphs are on the same order as those shown in FIGS. 24, 23 and 25. From the above, it can be understood that the cut design of the present invention can also be applied to the modified round brilliant cut.

Observation of Diamonds

As is apparent from the above description, when the ornamental diamond cut in a round brilliant cut manner in accordance with the present invention is observed, the features of the diamond can be best perceived if rays coming in through the table facet and the crown facets and coming out through the table facet and crown facets are observed from a position above the table facet an angle smaller than 20 degrees from a perpendicular (z-axis) to the table facet of the diamond. Distribution through an angular range from 0 to 90 degrees of incident rays coming in through the table facet and the crown facets of the diamond may suffice. Distribution of incident rays in an angular range from 10 to 50 degrees is more preferable, and distribution in an angular range from 20 to 45 degrees is particularly preferable.

While cases of observation with the human eye have already been described in the above, it is also possible for a person to observe a diamond by imaging patterns of reflection rays from a diamond with a digital camera or by forming an image on a CRT or the like using a signal picked up with a CCD camera.

The features of the diamond of the present invention can be grasped by observing and comparing the round brilliant cut diamond in accordance with the present invention and a conventional round brilliant cut diamond under the same conditions, for example, in such a manner that the diamonds are irradiated with rays uniformly incident on the table facet and the crown facets at angles of 20 to 45 degrees from a line perpendicular to the table facet and are simultaneously observed from a position above the table facet at a sight line angle smaller than 20 degrees. The two diamonds may also be observed under the same conditions and in the same fields of view through a microscope having dual objective lenses. Also, the two diamonds may be compared by being photographed under the same conditions with a digital camera.

In jewelry stores and the like, it is preferable that the diamond of the round brilliant cut according to the present invention is displayed in a window display so that a viewer can best perceive the features of the diamond cut according to the present invention. Namely, the diamond is displayed such that a customer at the jewelry stores can observe the diamond with a sight line angle of 20 degrees or less with a line perpendicular to a table facet of the diamond, and that the table facet and crown facets of the diamond are exposed to light distributing from 0 to 90 degrees with the perpendicular line of the table facet. The distributing angle range of the light is preferably 10 to 50 degrees with the perpendicular line and more preferably 20 to 45 degrees. The round brilliant cut diamond of the invention and a conventional round brilliant cut diamond may be positioned side by side in a window display so that a customer can compare them. Also, it is possible that the two kinds of diamonds are displayed in such a manner that a customer can observe them by a microscope under the same conditions. A photograph of a round brilliant cut diamond of the invention taken under the observation conditions described above may be printed on a sales promotion brochure and/or a certificate prepared by an appraiser or an jewelry expert to show the features of the diamond of the invention.

As described above, the diamond with the cut design in accordance with the present invention has a large amount of visual-perceptible reflection rays and looks brilliant in comparison with conventional diamonds. Also, the diamond of the present invention has a larger number of reflection ray patterns than that of conventional ones. These characteristics are noticeable when the sight line angle is smaller than 20 degrees, particularly smaller than 15 degrees. Each of the round brilliant cut diamond 1 shown in FIG. 1 and the modified round brilliant cut diamond 1' shown in FIG. 26 has these characteristics. However, when the diamond 1 and the diamond 1' are observed and compared by an observer, the observer can recognize a slight difference therebetween and can also be impressed with the novelty of the ornamental diamonds.

Figure 34:
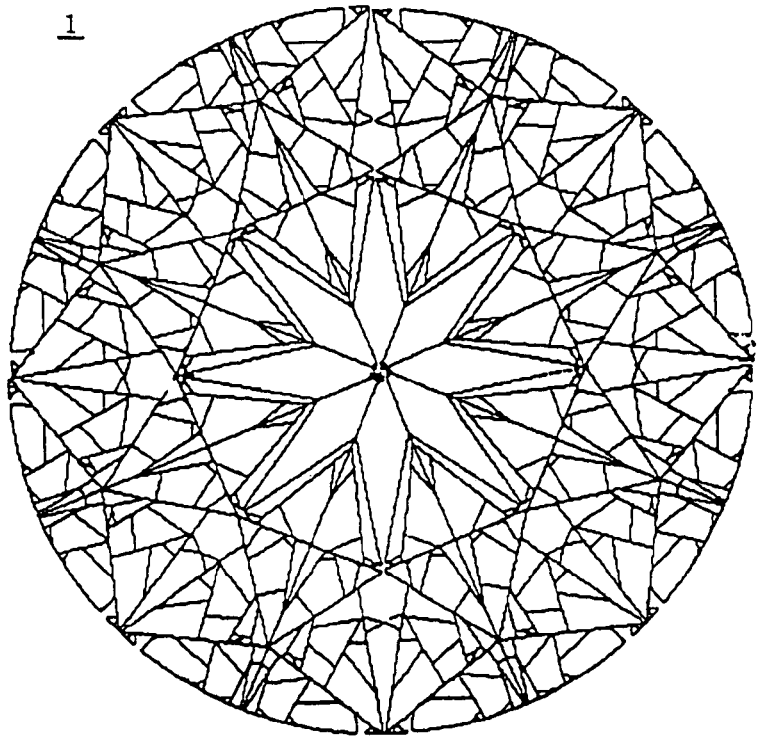
FIG. 34 is a diagram showing an example of reflection ray patterns seen when the diamond with the cut design of the present invention is observed from above the table facet.
Figure 35:
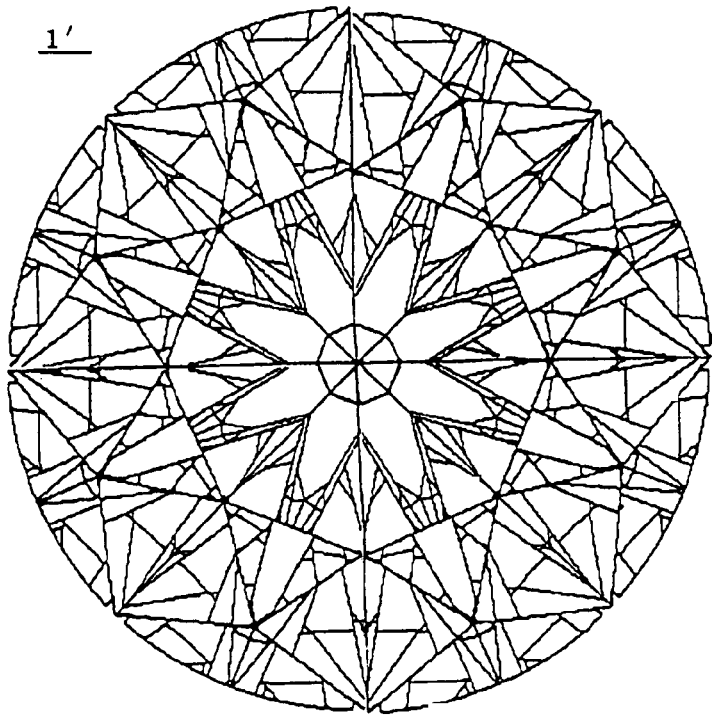
FIG. 35 is a diagram showing an example of reflection ray patterns seen when the diamond with the modified cut design of the present invention is observed from above the table facet.
Figure 36:
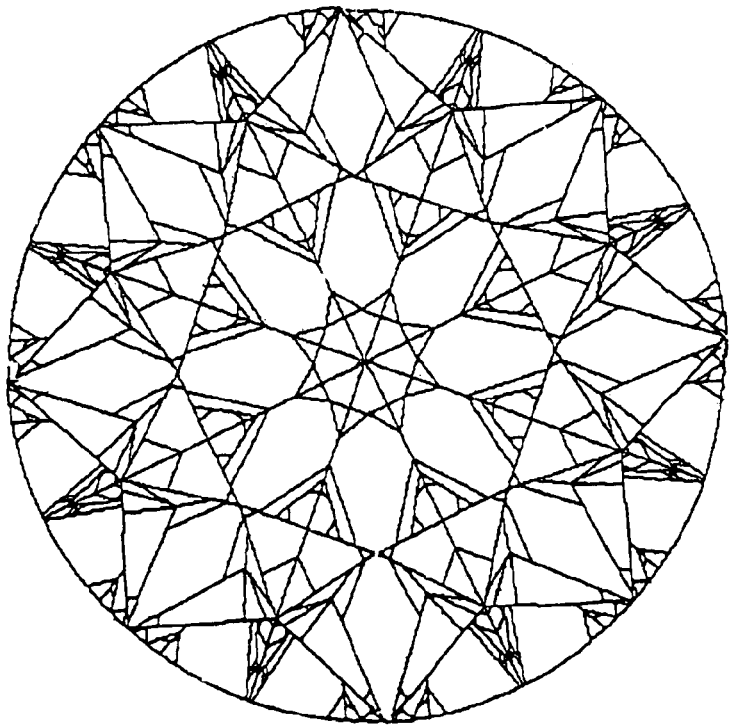
FIG. 36 is a diagram showing an example of reflection ray patterns seen when a diamond with a conventional cut design is observed from above the table facet.

FIGS. 34, 35 and 36 are enlarged diagrams of reflection ray patterns seen when the diamond 1 of the present invention, the modified round brilliant cut diamond 1' and a conventional diamond are observed from above. In the reflection ray patterns of the diamond 1 shown in FIG. 34, contour lines of the pavilion main facets are clearly seen in the table facet and in the bezel facets. In contrast, in the reflection ray patterns of the diamond 1' shown in FIG. 35, the pavilion main facets appear in the table facet and in the star facets, but a multiple-reflected pattern is superposed on the contour line of the pavilion main facets in a place close to the periphery of the table facet. In this place, the contour line of the pavilion main facets is not clear. Thus, in the reflection ray patterns of the diamond 1, the contour line is clearly seen and each pattern element gives the impression of being sharp and cool like a piece of glass. In contrast, in the reflection ray patterns of the modified diamond 1', the end of each pattern element looks as if it is curved, and give the impression of being soft. Also, since a multiple-reflected pattern is superposed in the reflection ray patterns of the modified diamond 1', the superposed reflection ray pattern has depth or a three dimensional appearance. In comparison between the reflection ray patterns shown in FIGS. 34 to 36, other features are also observed. However, they made different characteristic impressions on observers. Therefore, no description will be made on them in this specification.

In comparison with the diamond 1, the diamond 1' tends to maintain the amount of rays so that the amount of rays is not excessively small even when the diamond 1' is observed at an increased sight angle from the z-axis.

As described above in detail, the ornamental round brilliant cut diamond with the cut design in accordance with the present invention looks more brilliant than conventional diamonds when observed from a position close to a line perpendicular to the table facet. A larger number of fine reflection ray patterns are produced. Also for this reason, higher brilliancy from the diamond of the present invention can be observed. Also, since reflection ray patterns are formed mainly from rays incident at angles of 10 to 50 degrees, particularly at angles 20 to 45 degrees, an observer in front of the diamond can observe the reflection ray patterns without blocking the incident rays.

What is claimed is:

1. A method for displaying an ornamental diamond, the method comprising:

providing an ornamental diamond of a round brilliant cut which comprises a substantially round or polygonal girdle having an upper horizontal section and a lower horizontal section parallel to the upper horizontal section, a crown on the upper horizontal section of the girdle having a table facet and at least one crown main facet, and a pavilion below the lower horizontal section of the girdle having at least one pavilion main facet, wherein a girdle height (h) between the upper and the lower horizontal sections of the girdle is 0.026 to 0.3 times a girdle radius, a pavilion angle (p) between the pavilion main facet and the lower horizontal section of the girdle ranges from 37.5 degrees to 41 degrees, and a crown angle (c) between the crown main facet and the upper horizontal section of the girdle is within a range of satisfying the following inequalities:

$$c>-2.8667\times p+134.233 \text{ and}$$

$$p<1/4\times\{(\sin^{-1}(1/n)+\sin^{-1}(1/n\cdot\sin c))\times 180/\pi+180-2c\}$$

wherein n: refraction index of a diamond,

π: circular constant, p: pavilion angle in degrees, and c: crown angle in degrees and displaying said ornamental diamond to establish a location of observation that is above the table facet of the diamond such that visually perceptible light coming into the diamond through the table facet and crown facets including the crown main facets, star facets and crown girdle facets is emitted from the table facet and the crown facets with a sight line having an angle less than 20 degrees with a vertical line at the center of the table facet.

2. A method as set forth in claim 1, wherein the light coming into the diamond is at an angle ranging from 10 degrees to 50 degrees with the vertical line at the center of the table facet.

3. A method as set forth in claim 2, wherein the light coming into the diamond is at an angle ranging from 20 degrees to 45 degrees with the vertical line at the center of the table facet.

4. A method as set forth in claim 1, wherein the diamond has a girdle height (h) of 0.030 to 0.15 times the girdle radius.

5. A method as set forth in claim 1, wherein the diamond has a table diameter of 0.45 to 0.60 times a girdle diameter.

6. A method for viewing an ornamental diamond, the method comprising:

providing an ornamental diamond of a round brilliant cut which comprises:

a substantially round or polygonal girdle having an upper horizontal section surrounded by an upper periphery and a lower horizontal section, parallel to the upper horizontal section, surrounded by a lower periphery;

a crown of a nearly polygonal truncated pyramid formed upward above the upper horizontal section of the girdle having a regular octagonal table facet at the top of the polygonal truncated pyramid, eight crownmain facets, eight star facets and sixteen upper girdle facets; and a pavilion of a nearly polygonal pyramid formed downward below the lower horizontal section of the girdle having eight pavilion main facets and sixteen lower girdle facets, wherein a center axis stands from a center apex of the pavilion polygonal pyramid through a center of the table facet; first planes each runs from the center axis through each of eight vertexes of the table facet; and second planes each runs from the center axis and divides an angle between the two neighboring first planes into two equal angles, wherein each of the crown main facets is a rectangular plane surface having two opposite vertexes, one being one of vertexes of the table facet and the other being a cross point of the upper periphery of the girdle with a first plane passing the vertex of the table facet, the rectangular plane surface having other two opposite vertexes each positioned on a neighboring second plane and coinciding with a vertex of a neighboring crown main facet;

each of the star facets is a triangle having a base coinciding with a side of the table facet and a vertex coinciding with a coinciding vertex of two neighboring crown main facets each having a side passing each of the both ends of the base;

each of the upper girdle facets is a triangle having a side coinciding with one of sides of a crown main facet and crossing the upper periphery of the girdle at an end of the side and a vertex at which a second plane passing the other end of the side crosses the upper periphery of the girdle;

each of the pavilion main facets is a rectangular plane surface having two opposite vertexes, one being a cross point of a second plane with the lower periphery of the girdle and the other being at the center apex of the pavilion polygonal pyramid, the rectangular plane surface having other two opposite vertexes each positioned on a neighboring first plane, the pavilion main facets each having a side coinciding with a side ofa neighboring pavilion main facet and two vertexes coinciding with two vertexes of the neighboring pavilion main facet; and each of the lower girdle facets is a triangle having a side coinciding with a side of one of the pavilion main facets and crossing the lower periphery of the girdle at an end of the side and a vertex at which the first plane passing the other end of the side crosses the lower periphery of the girdle, wherein a girdle height (h) between the upper and the lower horizontal sections of the girdle is 0.026 to 0.3 times a girdle radius; a pavilion angle (p) between the pavilion main facet and the lower horizontal section of the girdle ranges from 37.5 degrees to 41 degrees;

and a crown angle (c) between the crown main facet and the upper horizontal section of the girdle is within a range of satisfying the following inequalities:

$$c>-2.8667\times p+134.233 \text{ and}$$

$$p<1/4\times\{(\sin^{-1}(1/n)+\sin^{-1}(1/n\cdot\sin c))\times 180/\pi+180-2c\}$$

wherein n: refraction index of a diamond,

π: circular constant, p: pavilion angle in degrees, and c: crown angle in degrees and positioning said ornamental diamond for viewing, above the table facet of the diamond, such that visually perceptible light coining into the diamond through the table facet and crown facets including the crown main facets, star facets and crown girdle facets is emitted from the table facet and the crown facets with a sight line having an angle less than 20 degrees with a vertical line at the center of the table facet.

7. A method as set forth in claim 6, wherein the light coining into the diamond is at an angle ranging from 10 degrees to 50 degrees with the vertical line at the center of the table facet.

8. A method as set forth in claim 7, wherein the light coming into the diamond is at an angle ranging from 20 degrees to 45 degrees with the vertical line at the center of the table facet.

9. A method as set forth in claim 6, wherein the diamond has a girdle height (h) of 0.030 to 0.15 times the girdle radius.

10. A method as set forth in claim 6, wherein the diamond has a table diameter of 0.45 to 0.60 times a girdle diameter.

11. A method for observing an ornamental diamond, the method comprising:

providing an ornamental diamond of a round brilliant cut which comprises:

a substantially round or polygonal girdle having an upper horizontal section surrounded by an upper periphery and a lower horizontal section, parallel to the upper horizontal section, surrounded by a lower periphery;

a crown of a nearly polygonal truncated pyramid formed upward above the upper horizontal section of the girdle having a regular octagonal table facet at the top of the polygonal truncated pyramid, eight crown main facets, eight star facets and sixteen upper girdle facets; and a pavilion of a nearly polygonal pyramid formed downward below the lower horizontal section of the girdle having eight pavilion main facets and sixteen lower girdle facets, wherein a center axis stands from a center apex of the pavilion polygonal pyramid through a center of the table facet; first planes each runs from the center axis through each of eight vertexes of the table facet; and second planes each runs from the center axis and divides an angle between the two neighboring first planes into two equal angles, wherein each of the crown main facets is a rectangular plane surface having two opposite vertexes, one being one of vertexes of the table facet and the other being a cross point of the upper periphery of the girdle with a first plane passing the vertex of the table facet, the rectangular plane surface having other two opposite vertexes each positioned on a neighboring second plane and coinciding with a vertex of a neighboring crown main facet;

each of the star facets is a triangle having a base coinciding with a side of the table facet and a vertex coinciding with a coinciding vertex of two neighboring crown main facets each having a side passing each of the both ends of the base;

each of the upper girdle facets is a triangle having a side coinciding with one of sides of a crown main facet and crossing the upper periphery of the girdle at an end of the side and a vertex at which a second plane passing the other end of the side crosses the upper periphery of the girdle;

each of the pavilion main facets is a rectangular plane surface having two opposite vertexes, one being a cross point of a second plane with the lower periphery of the girdle and the other being at the center apex of the pavilion polygonal pyramid, the rectangular plane surface having other two opposite vertexes each positioned on a neighboring first plane, the pavilion main facets each having a side coinciding with a side of a neighboring pavilion main facet and two vertexes coinciding with two vertexes of the neighboring pavilion main facet; and each of the lower girdle facets is a triangle having a side coinciding with a side of one of the pavilion main facets and crossing the lower periphery of the girdle at an end of the side and a vertex at which the first plane passing the other end of the side crosses the lower periphery of the girdle, wherein a girdle height (h) between the upper and the lower horizontal sections of the girdle is 0.026 to 0.3 times a girdle radius; a pavilion angle (p) between the pavilion main facet and the lower horizontal section of the girdle ranges from 37.5 degrees to 41 degrees; and a crown angle (c) between the crown main facet and the upper horizontal section of the girdle is within a range of satisfying the following inequalities:

$$c > -2.8667 \times p + 134.233 \text{ and}$$

$$p < 1/4 \times \{(\sin^{-1}(1/n) + \sin^{-1}(1/n \cdot \sin c)) \times 180/\pi + 180 - 2c\}$$

wherein n: refraction index of a diamond,

π: circular constant, p: pavilion angle in degrees, and c: crown angle in degrees and observing, above the table facet of the diamond, light coining into the diamond through the table facet and crown facets including the crown main facets, star facets and crown girdle facets and emitted from the table facet and the crown facets with a sight line having an angle less than 20 degrees with a vertical line at the center of the table facet.

12. A method as set forth in claim 11, wherein the light coming into the diamond is at an angle ranging from 10 degrees to 50 degrees with the vertical line at the center of the table facet.

13. A method as set forth in claim 12, wherein the light coming into the diamond is at an angle ranging from 20 degrees to 45 degrees with the vertical line at the center of the table facet.

14. A method as set forth in claim 11, wherein the diamond has a girdle height (h) of 0.030 to 0.15 times the girdle radius.

15. A method as set forth in claim 11, wherein the diamond has a table diameter of 0.45 to 0.60 times a girdle diameter.

* * * * *